US008742686B2

(12) United States Patent
Zampini, II et al.

(10) Patent No.: US 8,742,686 B2
(45) Date of Patent: Jun. 3, 2014

(54) SYSTEMS AND METHODS FOR PROVIDING AN OEM LEVEL NETWORKED LIGHTING SYSTEM

(75) Inventors: Thomas Lawrence Zampini, II, Bedford, MA (US); Mark Alphonse Zampini, Morris, CT (US)

(73) Assignee: Integrated Illumination Systems, Inc., Morris, CT (US)

( * ) Notice: Subject to any disclaimer, the term of this patent is extended or adjusted under 35 U.S.C. 154(b) by 617 days.

(21) Appl. No.: 12/236,784

(22) Filed: Sep. 24, 2008

(65) Prior Publication Data

US 2009/0085500 A1 Apr. 2, 2009

Related U.S. Application Data

(60) Provisional application No. 60/974,721, filed on Sep. 24, 2007.

(51) Int. Cl.
*H05B 41/36* (2006.01)

(52) U.S. Cl.
USPC ..... 315/297; 315/294; 315/320; 700/11; 362/253; 362/35; 257/84; 257/13

(58) Field of Classification Search
USPC ..... 315/297, 294, 320; 700/11; 362/253, 362/35; 257/84, 13
See application file for complete search history.

(56) References Cited

U.S. PATENT DOCUMENTS 4,139,770 A 2/1979 Beyersdorf
5,264,997 A 11/1993 Hutchisson et al.
5,465,199 A 11/1995 Bray et al.
5,561,346 A 10/1996 Byrne
5,659,582 A 8/1997 Kojima et al.
5,783,909 A 7/1998 Hochstein
5,803,579 A 9/1998 Turnbull et al.
5,909,429 A 6/1999 Satyanarayana et al.
5,947,587 A 9/1999 Keuper et al.
6,013,988 A 1/2000 Bucks et al.
6,016,038 A 1/2000 Mueller et al.
6,040,663 A 3/2000 Bucks et al.
6,094,014 A 7/2000 Bucks et al.

(Continued)

FOREIGN PATENT DOCUMENTS

WO WO-03/017733 A1 2/2003

OTHER PUBLICATIONS

"1-Wire Products Deliver a Powerful Combination . . . ", Mixed-Signal Design Guide, Dallas Semiconductor Maxim, 2005, 7 pages.
"Conductivity with the BS2/OWL2", EME Systems, 2002, pp. 1-3.

(Continued)

*Primary Examiner* — Tejal Gami
(74) *Attorney, Agent, or Firm* — Foley & Lardner LLP; Christopher J. McKenna

(57) ABSTRACT

The present application is generally directed to systems and methods for control and management of lighting components connected in a network. A user specified rule is executed to control lighting effects in a lighting network which comprises an interface module in communication with one or more lighting control modules. The interface module may receive a rule for controlling a lighting network. The rule may comprise a user identified input and a user specified lighting effect to occur responsive to the user identified input. The interface module detects receipt of the user identified input and executes the rule to trigger the user specified lighting effect via the one or more lighting control modules.

24 Claims, 22 Drawing Sheets

(56) References Cited

U.S. PATENT DOCUMENTS 6,127,783 A 10/2000 Pashley et al.
6,147,458 A 11/2000 Bucks et al.
6,150,774 A 11/2000 Mueller et al.
6,157,093 A 12/2000 Giannopoulos et al.
6,166,496 A 12/2000 Lys et al.
6,194,839 B1 2/2001 Chang
6,201,353 B1 3/2001 Chang et al.
6,211,626 B1 4/2001 Lys et al.
6,234,645 B1 5/2001 Borner et al.
6,234,648 B1 5/2001 Borner et al.
6,236,331 B1 5/2001 Dussureault
6,238,065 B1 5/2001 Jones
6,249,088 B1 6/2001 Chang
6,250,774 B1 6/2001 Begemann et al.
6,253,530 B1 7/2001 Price et al.
6,288,497 B1 9/2001 Chang et al.
6,292,901 B1 9/2001 Lys et al.
6,299,329 B1 10/2001 Mui et al.
6,304,464 B1 10/2001 Jacobs et al.
6,305,818 B1 10/2001 Lebens et al.
6,340,864 B1 1/2002 Wacyk
6,340,868 B1 1/2002 Lys et al.
6,384,545 B1 5/2002 Lau
6,411,046 B1 6/2002 Muthu
6,441,558 B1 8/2002 Muthu et al.
6,443,592 B1 9/2002 Unger et al.
6,445,139 B1 9/2002 Marshall et al.
6,459,919 B1 10/2002 Lys et al.
6,489,731 B1 12/2002 Bruning et al.
6,495,964 B1 12/2002 Muthu et al.
6,507,158 B1 1/2003 Wang
6,507,159 B2 1/2003 Muthu
6,510,995 B2 1/2003 Muthu et al.
6,513,949 B1 2/2003 Marshall et al.
6,528,954 B1 3/2003 Lys et al.
6,552,495 B1 4/2003 Chang
6,576,881 B2 6/2003 Muthu et al.
6,577,080 B2 6/2003 Lys et al.
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,608,453 B2 8/2003 Morgan et al.
6,609,813 B1 8/2003 Showers et al.
6,617,795 B2 9/2003 Bruning
6,621,235 B2 9/2003 Chang
6,630,801 B2 10/2003 Schuurmans
6,636,003 B2 10/2003 Rahm et al.
6,639,368 B2 10/2003 Sheoghong
6,676,284 B1 1/2004 Wynne Willson
6,692,136 B2 2/2004 Marshall et al.
6,720,745 B2 4/2004 Lys et al.
6,724,159 B2 4/2004 Gutta et al.
6,734,639 B2 5/2004 Chang et al.
6,741,351 B2 5/2004 Marshall et al.
6,762,562 B2 7/2004 Leong
6,777,891 B2 8/2004 Lys et al.
6,788,011 B2 9/2004 Mueller et al.
6,796,680 B1 9/2004 Showers et al.
6,796,686 B2 9/2004 Jacob et al.
6,801,003 B2 10/2004 Schanberger et al.
6,806,659 B1 10/2004 Mueller et al.
6,831,569 B2 12/2004 Wang et al.
6,853,150 B2 2/2005 Clauberg et al.
6,853,151 B2 2/2005 Leong et al.
6,859,644 B2 2/2005 Wang
6,922,022 B2 7/2005 Bucks et al.
6,930,452 B2 8/2005 De Krijger et al.
6,932,477 B2 8/2005 Stanton
6,933,685 B2 8/2005 Gutta et al.
6,933,767 B2 8/2005 Bucks et al.
6,965,205 B2 11/2005 Piepgras et al.
6,969,954 B2 11/2005 Lys
6,972,525 B2 12/2005 Bucks et al.
6,975,079 B2 12/2005 Lys et al.
6,992,803 B2 1/2006 Chang
6,998,594 B2 2/2006 Gaines et al.
7,014,336 B1 3/2006 Ducharme et al.
7,030,572 B2 4/2006 Nijhof et al.
7,031,920 B2 4/2006 Dowling et al.
7,038,398 B1 5/2006 Lys et al.
7,038,399 B2 5/2006 Lys et al.
7,064,498 B2 6/2006 Dowling et al.
7,067,992 B2 6/2006 Leong et al.
7,071,762 B2 7/2006 Xu et al.
7,113,541 B1 9/2006 Lys et al.
7,118,248 B2 10/2006 Wynne Willson
7,132,804 B2 11/2006 Lys et al.
7,135,824 B2 11/2006 Lys et al.
7,139,617 B1 11/2006 Morgan et al.
7,140,752 B2 11/2006 Ashdown
7,161,311 B2 1/2007 Mueller et al.
7,161,313 B2 1/2007 Piepgras et al.
7,161,556 B2 1/2007 Morgan et al.
7,178,941 B2 2/2007 Roberge et al.
7,180,252 B2 2/2007 Lys et al.
7,186,003 B2 3/2007 Dowling et al.
7,202,608 B2 4/2007 Robinson et al.
7,202,613 B2 4/2007 Morgan et al.
7,202,641 B2 4/2007 Claessens et al.
7,204,622 B2 4/2007 Dowling et al.
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,253,566 B2 8/2007 Lys et al.
7,255,457 B2 8/2007 Ducharme et al.
7,255,458 B2 8/2007 Ashdown
7,256,554 B2 8/2007 Lys
7,262,559 B2 8/2007 Tripathi et al.
7,267,461 B2 9/2007 Kan et al.
7,274,160 B2 9/2007 Mueller et al.
7,300,192 B2 11/2007 Mueller et al.
7,308,296 B2 12/2007 Lys et al.
7,309,965 B2 12/2007 Dowling et al.
7,314,289 B2 1/2008 Montagne
7,319,298 B2 1/2008 Jungwirth et al.
7,323,676 B2 1/2008 Duijve
7,329,998 B2 2/2008 Jungwirth
7,350,936 B2 4/2008 Ducharme et al.
7,352,138 B2 4/2008 Lys et al.
7,352,339 B2 4/2008 Morgan et al.
7,353,071 B2 4/2008 Blackwell et al.
7,354,172 B2 4/2008 Chemel et al.
7,358,679 B2 4/2008 Lys et al.
7,358,681 B2 4/2008 Robinson et al.
7,358,706 B2 4/2008 Lys
7,358,929 B2 4/2008 Mueller et al.
7,358,961 B2 4/2008 Zwanenburg
7,387,405 B2 6/2008 Ducharme et al.
7,388,665 B2 6/2008 Ashdown
7,394,210 B2 7/2008 Ashdown
7,420,335 B2 9/2008 Robinson et al.
7,423,387 B2 9/2008 Robinson et al.
7,432,668 B2 10/2008 Zwanenburg et al.
7,443,209 B2 10/2008 Chang
7,449,847 B2 11/2008 Schanberger et al.
7,453,217 B2 11/2008 Lys et al.
7,459,864 B2 12/2008 Lys
7,462,997 B2 12/2008 Mueller et al.
7,463,070 B2 12/2008 Wessels
7,482,565 B2 1/2009 Morgan et al.
7,482,760 B2 1/2009 Jungwirth et al.
7,490,953 B2 2/2009 Holten et al.
7,490,957 B2 2/2009 Leong et al.
7,495,671 B2 2/2009 Chemel et al.
7,502,034 B2 3/2009 Chemel et al.
7,505,395 B2 3/2009 Ashdown et al.
7,507,001 B2 3/2009 Kit
7,511,436 B2 3/2009 Xu
7,511,437 B2 3/2009 Lys et al.
7,515,128 B2 4/2009 Dowling

(56) References Cited

U.S. PATENT DOCUMENTS 7,520,634 B2 4/2009 Ducharme et al.
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,572,028 B2 8/2009 Mueller et al.
7,573,209 B2 8/2009 Ashdown et al.
7,573,210 B2 8/2009 Ashdown et al.
7,573,729 B2 8/2009 Elferich et al.
7,598,681 B2 10/2009 Lys et al.
7,598,684 B2 10/2009 Lys et al.
7,598,686 B2 10/2009 Lys et al.
7,619,370 B2 11/2009 Chemel et al.
7,652,236 B2 1/2010 Cortenraad et al.
7,654,703 B2 2/2010 Kan et al.
7,656,366 B2 2/2010 Ashdown
7,658,506 B2 2/2010 Dowling
7,659,673 B2 2/2010 Lys
7,659,674 B2 2/2010 Mueller et al.
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,689,130 B2 3/2010 Ashdown
7,703,951 B2 4/2010 Piepgras et al.
7,710,369 B2 5/2010 Dowling
7,712,926 B2 5/2010 Matheson
7,714,521 B2 5/2010 Qian
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,738,002 B2 6/2010 Ashdown et al.
7,740,375 B2 6/2010 Zou et al.
7,766,489 B2 8/2010 Duine et al.
7,766,518 B2 8/2010 Piepgras et al.
7,772,787 B2 8/2010 Ashdown et al.
7,777,427 B2 8/2010 Stalker, III
7,781,979 B2 8/2010 Lys
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,845,823 B2 12/2010 Mueller et al.
7,850,347 B2 12/2010 Speier et al.
7,854,539 B2 12/2010 Van Duijneveldt
7,868,562 B2 1/2011 Salsbury et al.
7,878,683 B2 2/2011 Logan et al.
7,878,688 B2 2/2011 Paulussen et al.
7,893,631 B2 2/2011 Speier
7,893,661 B2 2/2011 Ackermann et al.
7,894,050 B2 2/2011 Ashdown et al.
7,906,917 B2 3/2011 Tripathi et al.
7,911,151 B2 3/2011 Xu
7,914,173 B2 3/2011 Paulussen et al.
8,022,632 B2 9/2011 Schulz et al.
8,026,673 B2 9/2011 Lys
2002/0074559 A1 6/2002 Dowling et al.
2003/0132721 A1 7/2003 Jacobs et al.
2003/0133292 A1 7/2003 Mueller et al.
2004/0052076 A1 3/2004 Mueller et al.
2004/0090191 A1 5/2004 Mueller et al.
2004/0178751 A1 9/2004 Mueller et al.
2005/0236998 A1 10/2005 Mueller et al.
2005/0275626 A1 12/2005 Mueller et al.
2006/0002110 A1 1/2006 Dowling et al.
2006/0022214 A1* 2/2006 Morgan et al. ..... 257/99
2006/0076908 A1 4/2006 Morgan et al.
2006/0114201 A1 6/2006 Chang
2006/0152172 A9 7/2006 Mueller et al.
2006/0221606 A1 10/2006 Dowling
2006/0262521 A1 11/2006 Piepgras et al.
2006/0274526 A1 12/2006 Weston et al.
2006/0290624 A1 12/2006 Ashdown
2007/0063658 A1 3/2007 Van Der Veeken
2007/0086912 A1 4/2007 Dowling et al.
2007/0115658 A1 5/2007 Mueller et al.
2007/0145915 A1 6/2007 Roberge et al.
2007/0153514 A1 7/2007 Dowling et al.
2007/0230159 A1 10/2007 Cortenraad et al.
2007/0258240 A1 11/2007 Ducharme et al.
2007/0273290 A1 11/2007 Ashdown et al.
2008/0042599 A1 2/2008 Ashdown
2008/0043464 A1 2/2008 Ashdown
2008/0048582 A1 2/2008 Robinson
2008/0062413 A1 3/2008 Ashdown et al.
2008/0089060 A1 4/2008 Kondo et al.
2008/0094005 A1 4/2008 Rabiner et al.
2008/0122386 A1 5/2008 De Brouwer et al.
2008/0136331 A1 6/2008 Schmeikal
2008/0136796 A1 6/2008 Dowling
2008/0140231 A1 6/2008 Blackwell et al.
2008/0164826 A1 7/2008 Lys
2008/0164854 A1 7/2008 Lys
2008/0167734 A1 7/2008 Robinson et al.
2008/0183081 A1 7/2008 Lys et al.
2008/0239675 A1 10/2008 Speier
2008/0265797 A1 10/2008 Van Doorn et al.
2008/0278092 A1 11/2008 Lys et al.
2008/0278941 A1 11/2008 Logan et al.
2008/0290251 A1 11/2008 Deurenberg et al.
2008/0297066 A1 12/2008 Meijer et al.
2008/0298330 A1 12/2008 Leitch
2008/0315798 A1 12/2008 Diederiks et al.
2009/0002981 A1 1/2009 Knibbe
2009/0021175 A1 1/2009 Wendt et al.
2009/0021182 A1 1/2009 Sauerlaender
2009/0072761 A1 3/2009 Wessels
2009/0128059 A1 5/2009 Joosen et al.
2009/0134817 A1 5/2009 Jurngwirth et al.
2009/0160364 A1 6/2009 Ackermann et al.
2009/0168415 A1 7/2009 Franciscus Deurenberg et al.
2009/0179587 A1 7/2009 Van Der Veen et al.
2009/0179596 A1 7/2009 Willaert et al.
2009/0189448 A1 7/2009 Verschueren
2009/0224695 A1 9/2009 Van Erp et al.
2009/0230884 A1 9/2009 Van Doorn et al.
2009/0243507 A1 10/2009 Lucero-Vera et al.
2009/0278473 A1 11/2009 Van Erp et al.
2009/0284174 A1 11/2009 Sauerlander et al.
2009/0321666 A1 12/2009 Hilgers
2010/0007600 A1 1/2010 Deurenberg et al.
2010/0026191 A1 2/2010 Radermacher et al.
2010/0045478 A1 2/2010 Schulz et al.
2010/0072901 A1 3/2010 De Rijck et al.
2010/0072902 A1 3/2010 Wendt et al.
2010/0079085 A1 4/2010 Wendt et al.
2010/0079091 A1 4/2010 Deixler et al.
2010/0084995 A1 4/2010 Baaijens et al.
2010/0091488 A1 4/2010 Ijzerman et al.
2010/0094439 A1 4/2010 Van De Meulenhof et al.
2010/0102732 A1 4/2010 Peeters et al.
2010/0117543 A1 5/2010 Van Der Veen et al.
2010/0117656 A1 5/2010 Snelten
2010/0118531 A1 5/2010 Montagne
2010/0127633 A1 5/2010 Geerts et al.
2010/0134041 A1 6/2010 Radermacher et al.
2010/0134042 A1 6/2010 Willaert
2010/0148689 A1 6/2010 Morgan et al.
2010/0164399 A1 7/2010 Radermacher et al.
2010/0165618 A1 7/2010 Vissenberg et al.
2010/0171771 A1 7/2010 Otte et al.
2010/0181936 A1 7/2010 Radermacher et al.
2010/0188007 A1 7/2010 Deppe et al.
2010/0194293 A1 8/2010 Deurenberg et al.
2010/0231133 A1 9/2010 Lys
2010/0231363 A1 9/2010 Knibbe
2010/0244707 A1 9/2010 Gaines et al.

(56) References Cited

U.S. PATENT DOCUMENTS

| | | | |
|---|---|---|---|
| 2010/0244734 | A1 | 9/2010 | Van Herpen et al. |
| 2010/0259182 | A1 | 10/2010 | Man et al. |
| 2010/0264834 | A1 | 10/2010 | Gaines et al. |
| 2010/0271843 | A1 | 10/2010 | Holten et al. |
| 2010/0289532 | A1 | 11/2010 | Wendt et al. |
| 2010/0301780 | A1 | 12/2010 | Vinkenvleugel |
| 2010/0308745 | A1 | 12/2010 | Delnoij |
| 2011/0025205 | A1 | 2/2011 | Van Rijswick et al. |
| 2011/0025230 | A1 | 2/2011 | Schulz et al. |
| 2011/0035404 | A1 | 2/2011 | Morgan et al. |
| 2011/0042554 | A1 | 2/2011 | Hilgers et al. |
| 2011/0090684 | A1 | 4/2011 | Logan et al. |
| 2011/0095694 | A1 | 4/2011 | Justel et al. |
| 2011/0285292 | A1 | 11/2011 | Mollnow et al. |
| 2011/0291812 | A1 | 12/2011 | Verbrugh |
| 2012/0019670 | A1 | 1/2012 | Chang et al. |

OTHER PUBLICATIONS

"Dimmable Fluorescent Ballast", ATAVRFBKIT/EVLB001, User Guide, ATMEL, 2007, pp. 1-33.
"High-side current sensing for driving a string of white LEDs", EDN, 1 page.
"Understanding Boost Power Stages in Switchmode Power Supplies", Application Report, Texas Instruments, Mixed Signal Products, Mar. 1999, pp. 1-28.
"Understanding Buck Power Stages in Switchmode Power Supplies", Application Report, Texas Instruments, Mixed Signal Products, Mar. 1999, pp. 1-32.
Barberis, C. "Precision current sink costs less than $20", EDN Design Ideas.
Bellcomb Technologies Incoporated, "Edges, Joiners, Attachments, Web Address: http://www.bellcomb.com/caps/edges.htm", Apr. 22, 2007, pp. 1-3.
Bookmarks Menu—Controllers/Wireless—Deisgn Ideas, dated Dec. 6, 2012, 2 pages.
Bowling, S. "Buck-Boost LED Driver Using the PIC16F785 MCU", Microchip, AN1047, 2006, pp. 1-12.
By Staff, DALI Delivers Control and Cost Savings, Headaches Too, Consulting-Specifying Engineer, Jun. 2002, 2 pages.
Canny, D. "Controlling slew times tames EMI in offline supplies", EDN Design Ideas, Nov. 14, 2002.
Control Freak Addict Data Sheet, Copyright 2008, Creative Lighting, 5 pages.
Curtis, K. "High Power IR LED Driver Using the PIC16C781/782", Microchip, TB062, 2002, pp. 1-8.
CybroTech, Managing Lights with Dali, TN-012, rev 2, Cybrotech Ltd., 2007, 11 pgs.
Cypress Perform, Implementing an Integrated DMX512 Receiver, Item ID: 39762, Dec. 16, 2009, 1 pg.
Cypress Semiconductor Corporation, PowerPSoC (TM) Intelligent LED Driver, Document No. 001-46319, Rev. *G, 2009.
Dali-AG website, Dali at work, 1 pg.
Davidovic, et al., Lead-Acid Battery Charger Becomes A Subfuction In A Microcontroller, The Authority on Emerging Technologies for Design Solutions, Mar. 2007, 2 pages.
Davmark Ltd., Dali-Protocol, 2007, 6 pages.
Di Jasio, "A Technique to Increase the Frequency Resolution of PICmicro MCU PWM Modules", Microchip, AN1050, 2006, pp. 1-10.
Dietz, et al. "Very Low-Cost Sensing and Communication Using Bidirectional LEDs", Mitsubishi Electric Research Laboratories, Jul. 2003, 19 pgs.
Distler, T. "LED Effects Stream TM v2.0 Protocol (Revision C)", Jun. 2, 2005, pp. 1-5.
Dunn, J. "Matching MOSFET Drivers to MOSEFTs", Microchip, AN799, 2004, pp. 1-10.
Fosler, R. "The RS-232/DALI Bridge Interface", Microchip, AN811, 2002, pp. 1-8.
Fosler, R. "Use a microcontroller to design a boost converter", EDN design ideas, Mar. 4, 2004, pp. 74-75.
Fosler, R., et al. "Digitally Addressable DALI Dimming Ballast", Microchip, AN809, 2002, pp. 1-18.
Ghulyani, L. "Simple MPPT-Based Lead Acid Charger Using bq2031", Texas Instruments, Dec. 2009, pp. 1-5.
Google Search Results for dali query group, search completed on Apr. 8, 2010, accessed at google.com, http://www.google.com/search?hl=en&c1ient=firefox-a&rls=org.mozilla:en-, 2 pages.
Hardwick, M. "DC power wire also carries clock or data", EDN Design Ideas.
Hexcel Composites, "Sandwich Panel Fabrication Technology", Web Address: http://www.hexcel.com/NR/rdonlyres/B4574C2C-0644-43AC-96E2-CC15967A4b)5/4547 Sandwich Fabrication.pdf, Jan. 1997, pp. 1-16.
High-Side Current Monitor, ZETEX, Apr. 2001, ZXCT1009, Issue 3, pp. 1-8.
Implementing Infrared Object Detection, http://web.archive.org/web/20080528042614rejwww.seattlerobotics.org/guide/infrared.html, original publication date known, retrieved Apr. 7, 2010, seattlerobotics.org, 4 pages.
Jackson, S. "Circuit protects bus from 5V swings", EDN Design Ideas, Nov. 14, 2002.
Klepin, K. "Temperature Compensation for High Brightness LEDs using EZ-Color (TM) and PSoC Express", Cypress Perform, AN14406, Aug. 10, 2007, pp. 1-4.
Kremin, V. et al. "Multichannel LED Dimmer with CapSense Control—AN13943", Cypress Perform, Jul. 20, 2007.
Kropf, B. "Firmware—RGB Color Mixing Firmware for EZ-Color (TM)—AN16035", Cypress Perform, Jun. 13, 2007, pp. 1-7.
Lager, A. "Use a 555 timer as a switch-mode power supply", EDN Design Ideas, Nov. 14, 2002.
Lee, M. Shunt Battery Charger Provides 1A Continuous Current, EDN Magazine, 1997.
Locher, R. "Introduction to Power MOSEFETs and their Applications", Fairchild Semiconductor (TM), Application Note 558, Rev B, Oct. 1998, 15 pgs.
Miller, R. "Digital addressable lighting interface protocol fosters systems interoperability for lower costs and greater design flexibility", RNM Engineering, Inc., Apr. 2003, pp. 1-20.
Nell, S. "VCO uses programmable logic", EDN Design Ideas, Nov. 14, 2002.
News & Events DALI Digital addressable lighting interface lamp luminaire control, accessed at http://www.dali-ag.org/ on Apr. 8, 2010, original publication date unknown, updated Apr. 8, 2010, 1 pg.
O'Loughlin, M. "350-W, Two-Phase Interleaved PFC Pre-regulator Design Review", Texas Instruments, Application Report, Revised Mar. 2007, pp. 1-.
O'Loughlin, M., PFC Pre-Regulator Frequency Dithering Circuit, Texas Instruments, May 2007, pp. 1-8.
Perrin, R. Inexpensive Relays Form Digital Potentiometer, EDN Design Ideas, 1998, 2 pages.
Petersen, A. "Harness solar power with smart power-conversion techniques", EDN, Green Electronics designfeature, Feb. 4, 1999, pp. 119-124.
Prendergast, P. "How to Design a Three-Channel LED Driver", Cypress Perform, Jan. 2008, pp. 1-9.
Renesas, R8C/25 Demonstration Example for DALI Lighting Protocol Stack, REU05BOO77-0100/Rev. 1.00, Jul. 2008, 14 pgs.
Richardson, C., Matching Driver to LED, National Semiconductor, Jan. 2008, 5 pgs.
Richardson. C., LM3404 Driving a Seoul Semi Zpower P4 1A LED-RD-I34, National Semiconductor, Apr. 2007, 6 pages.
Shanmugam, S. "Design of a linear Fresnel lens system for solar photovoltaic electrical power source", Center for Robotics Research.
Shill, M. "Simple logic probe uses bicolor LED", EDN Design Ideas.
Software Design Specification, Z-Wave Protocol Overview, Z wave the wireless language, Zensys A/S, May 9, 2007, pp. 1-16.
Soundlight, Operating Manual, DALI and DMX Dekoder 7064A-H Mk1, 2008, 8 pgs.
Takahashi A., Methods and Features of LED Drivers, National Semiconductor, Mar. 2008, 3 pgs.

(56) References Cited

OTHER PUBLICATIONS

Universal Powerline Bus Communication Technology, Overview, PCS Powerline Control Systems UPB (Universal Powerline Bus), Jan. 8, 2002, pp. 1-13.
UPB Technology Description, PCS—Powerline Control Systems, UPB (Universal Powerline Bus), Version 1.4, Apr. 16, 2007, 68 pages.
Use Gate Charge to Design the Gate Drive Circuit for Power MOSEFETs and IGBTs, International Rectifier, Application Note AN-944, 5 pgs.
Van Dorsten, Arian, A Low Cost Step-up Converter by IC 555, posted Jul. 21, 2007, http://www.eleccircuit.comla-low-cost-step-up-converter-by-ic-5551, retrieved Apr. 7, 2010, 2 pages.
Walma, K., DALI: Forerunner of Today's Breakthrough Lighting Technology, Feb. 2007, 2 pages.
Wikipedia, Digital Addressable Lighting Interface, original publication date unknown, Retrieved from:Retrieved from "http://en.wikipedia.org/wikiJDigital_Addressable_Lighting_Interface" accessed on Apr. 8, 2010, 3 pages.
Witt, J. "Switched-capacitor regulator provides gain", EDN Design Ideas.
Wojslaw, C. "DPP adds versatility to VFC", EDN, design ideas, Nov. 14, 2002, pp. 99-110.
Young, R. "Power circuit terminates DDR DRAMs", EDN Design Ideas, Nov. 14, 2002.
Zarr, R. Driving High-Power LEDs, Machine Design, Oct. 2007, 3 pages.
Zensys ASCII Interface, VIZIA, 2007.
Zetex, High-Side Current Monitor, Apr. 2001, Issue 3, 8 pages.
Z-Wave Vizia Etc thread, retrieved at http://groups.google.com/group/comp.home.automation/browse_thread/thread/449c2c66934dfSfb/fSI12116a8231aa1?Ink=st&q=z-wave&rnum=98#fSI12116a8231aa1, www.ztech.com, 18 pages.

* cited by examiner

Configuration Tool 320

Configuration Tool 320

Configuration Tool 320

Configuration Tool 320

Begin Configuration of LED Control Modules (LCM)

i2SNET – [Project 1.iis]

File Edit View Format Tools Window Help

Step 1: Configure LED Control Modules

Enter below the addresses of your LED Control Modules. The address is physically labeled to your LED Control Modules.

Click Here to create a recurring address scheme / batch label.

| | |
|---|---|
| **LCM 1** | **123456789** |
| **LCM 2** | **ABCDEFG** |
| **LCM 3** | **A1A2A3A4** |

<<BACK NEXT >>

Configuration Tool 320

FIG. 3F

Configuration Tool 320

Configuration Tool 320

Configuration Tool 320

Configuration Tool 320

Begin Configuration of LED Control Modules (LCM)

i2SNET – [Project 1.iis]

File Edit View Format Tools Window Help

Step 2: Configure the User Interface Module (UIM)

350 Create a Rule for Interface 1 (Motion Sensor)

(note that there will be a selection of possible rules to pick from as well as drop down menus to assist in rule creation)

Upon Sensing Motion, Fade Light Output up to 100% over 2 seconds and maintain 100% light output for 2 minutes. At the end of 2 minutes, Fade Light Output down to 0% until again Sensing Motion

Apply this rule to LED Control Modules:

☑ 123456789 ☐ A1A2A3A4

☑ ABCDEFG

<<BACK NEXT >>

Configuration Tool 320

FIG. 3K

Begin Configuration of LED Control Modules (LCM)

i2SNET – [Project 1.iis]

File Edit View Format Tools Window Help

Step 2: Configure the User Interface Module (UIM)

350 Create a Rule for Interface 1 (Motion Sensor)

(note that there will be a selection of possible rules to pick from as well as drop down menus to assist in rule creation)

Upon Sensing Motion, Strobe Light Output for 10 minutes between 3% Output and 100% Output each Strobe lasting .1 Seconds

Apply this rule to LED Control Modules:

☐ 123456789 ☑ A1A2A3A4

☐ ABCDEFG

<<BACK NEXT >>

Configuration Tool 320

FIG. 3L

Configuration Tool 320

Configuration Tool 320

SYSTEMS AND METHODS FOR PROVIDING AN OEM LEVEL NETWORKED LIGHTING SYSTEM

RELATED APPLICATIONS

The present application claims priority to U.S. Provisional Application No. 60/974,721 filed on Sep. 24, 2007, herein incorporated by reference in its entirety.

FIELD OF THE INVENTION

The present application is generally directed towards providing control and management of LED systems via a network.

BACKGROUND

The Lighting Emitting Diode (LED) lighting industry is a fast growing market. LED lighting offers a strong value proposition as a lighting solution by reducing maintenance expense and lowering energy requirements for lighting systems while not producing hazardous materials. As such, traditional lighting original equipment manufacturers (OEMs) continue to adopt the LED light source for typical lighting applications. However the lack of standardization in the industry and special requirements for powering and controlling LED systems are a barrier to entry. There currently exists no LED "bulb" that provides adequate illumination as a light source. Most fixture manufacturers create new or retrofit existing luminaries to accommodate LED light sources. These LED light sources require proper thermal management and optical design. In addition to the overall mechanics, the electrical requirements of an LED source may be demanding. The LED is a low voltage DC device and sensitive to voltage and current fluctuations.

Some companies have developed packaged drivers, "LED Drivers", for LED luminaries. These LED drivers are essentially constant current power supplies configured to provide a set current value to the LEDs despite the input voltage to the luminaire. For example, an LED driver may take a 120VAC input and provide a 350 mA constant current output. In addition to these packaged "LED Drivers," other semiconductor OEMs are developing LED Driver "chips." These LED chips are integrated circuits that may be incorporated at the board level to integrate sensing technology and digital or analog input for providing power to the LED luminaire.

There are two typical LED driver customers. The first is what may be considered a traditional lighting OEM customer. These traditional OEM companies have specialized in packaging to incorporate standard ballasts and bulbs into metal and plastic housings with all components being plug and play and typically color coded. In most cases, this type of LED customer uses the traditional ballast style "LED Driver" packaged such that wire leads may be easily connected to predefined inputs and outputs. The second type of customer is one who understands electronic design and designs a printed circuit board ("PCB") that will accommodate an LED driver chip. This type of customer will specifically customize the PCB for the target application.

It is unlikely to find these two types of customers are one in the same. As such, the LED OEM driver typically provides either the simple plug and play LED driver or a customized LED driver solution. The first type of customer uses the simple LED Driver plug and play solution that provides conventional and convenient means of hookup. However, these plug and play solutions offer no means of advanced lighting control, such as flashing sequences, color mixing, etc. The second type of customer may obtain an advanced control solution but through the integration of highly sophisticated control system in which the programming is done at the job site such that sequencing and effects may be achieved at the control panel level. However, these integrated systems are complex, require much setup, customized for every job, and are expensive such that only the highest end applications receive such integration.

SUMMARY

The systems and methods of the present disclosure described herein addresses the large void in the OEM LED driver market between the simple plug and play LED driver and the customized and complex integrated LED driver systems. The present disclosure provides an LED control and management system to create sophisticated, networked and integrated LED based lighting systems without requiring knowledge of electronic design or complex programming. This LED control system provides a level of simplicity and user friendliness of the previous plug and play LED driver solution while providing the advanced control capabilities of the more complex, integrated systems. Additionally, the LED control system offers versatility such that each module of the system may be configured to function as needed for the overall system. A configuration package of the solution provides a simple configuration tool to configure the functionality of each of the modules without complexity.

In overview, the LED control system of the present solution includes a programmable LED Control Module ("LCM"), a programmable User Interface Module ("UIM") and a computer based configuration software package ("CSP"). The UIM and LCM modules are network enabled devices that communicate with each other to form a lighting network for controlling and managing one or more LCD sources. This network may be wireless. The LCM controls the light output of various off the shelf or custom designed LED Drivers which power LEDs installed to an LED Light Fixture. The UIMs receive digital data or analog signals in which they interpret and provide the correct commands and sequences to the LCMs via wireless or wired communication. The LCM receives the commands from the UIM to control the light output of the LED in accordance with the command. The CSP provides a configuration tool to create rules or command sequences for controlling the lighting based on triggers from the signals received by the UIM.

The present disclosure offers many advantages including standardization of the LCM and UIM that may be configured to interface with any digital and/or analog input and to provide any LED driver output. Real time data available from any type and form of input, such as physical sensors or Internet input may trigger and influence the lighting effects managed via the UIM and LCM. The system leverages and uses any existing LED source and driver technology such that the LCM control system is an addition to instead of a replacement for this technology. Furthermore, the integration of wireless communications between the LCM and UIM modules enables the deployment of advanced illumination capabilities for retrofit installations The use of user friendly, drag and drop and wizard based configuration software allows any non-technical designer to create advanced lighting control rules.

In some aspects, the present disclosure is related to systems and methods for executing a user specified rule to control lighting effects in a lighting network. The lighting network may comprise an interface module in communication with one or more lighting control modules. The interface module may receive a rule for controlling a lighting network. The interface module may be in communication with one or more lighting control modules of the lighting network. The rule may comprise a user identified input and a user specified lighting effect to occur via the one or more lighting control modules responsive to the user identified input. The interface module may detect the receipt of the user identified input and execute, in response to the detection, the rule to trigger the user specified lighting effect via the one or more lighting control modules.

In some embodiments, the interface module receives a set of executable instructions comprising the rule. In numerous embodiments, the interface module receives the rule comprising a user specified predetermined threshold of the user identified input for which to trigger the user specified lighting effect. Sometimes, the interface module may receive data as input via one or more analog or digital ports of the interface module. Sometimes the interface module may receive data as input via a network port of the interface module. In some embodiments, the interface module detects the user identified input from a stream of data received via a port. In a variety of embodiments, any one of lighting network components communicates one or more instructions to the one or more lighting control modules to produce the user specified lighting effect. Sometimes, any one of lighting network components communicates one or more instructions to the one or more lighting control modules to produce the user specified lighting effect for a user specified time period. The instructions may be communicated via a variety of ways to program the one or more lighting control modules.

In some aspects, the present disclosure is related to systems and methods for configuring a user specified rule to control lighting effects in a lighting network which comprises an interface module in communication with one or more lighting control modules. A configuration tool may receive a user's identification of an input to be received via an interface module for controlling one or more lighting control modules of a lighting network. The configuration tool may receive a user's specification of a lighting effect to occur via the one or more lighting control modules and responsive to the user identified input. In many embodiments, the configuration tool provides for execution on the interface module a rule comprising the user specified lighting effect to occur via the one or more lighting control modules responsive to the user identified input.

In some embodiments, the configuration tool or any other lighting network component receives a user's identification of a value of data that may be received by an analog or digital interface of the interface module. In many embodiments, the configuration tool or any other lighting network component receives a user's identification of a value of data that may be received via network interface of the interface module. Sometimes, the configuration tool may receive a user's identification of the input based on a type of interface configured on the interface module. In some embodiments, the configuration tool or any other lighting network component receives a user's specification of the lighting effects as a sequence of one or more instructions to communicate to the one or more lighting control modules. The configuration tool may also receive a user's specification of the lighting effects as a sequence of one or more instructions to communicate to the one or more lighting control modules. In some embodiments, the configuration tool receives a user's specification of the lighting effect as an identification of a program to execute on the one or more lighting control modules. In a number of embodiments, the configuration tool receives a user's specification of the lighting effect as an identification of a program to execute on the interface module. In a number of embodiments, the user specifies a lighting scheme for the lighting effect. The configuration tool may generate a set of executable instructions representing the rule. In some embodiments, any lighting network component may communicate the set of executable instructions to the interface module.

The details of various embodiments of the present solution are set forth in the accompanying drawings and the description below.

BRIEF DESCRIPTION OF THE FIGURES

The foregoing and other objects, aspects, features, and advantages of the present invention will become more apparent and better understood by referring to the following description taken in conjunction with the accompanying drawings, in which:

FIGS. 3B-3N are block diagrams depicting embodiments of user interfaces of configuration tool of the CSP.

Figure 1A:
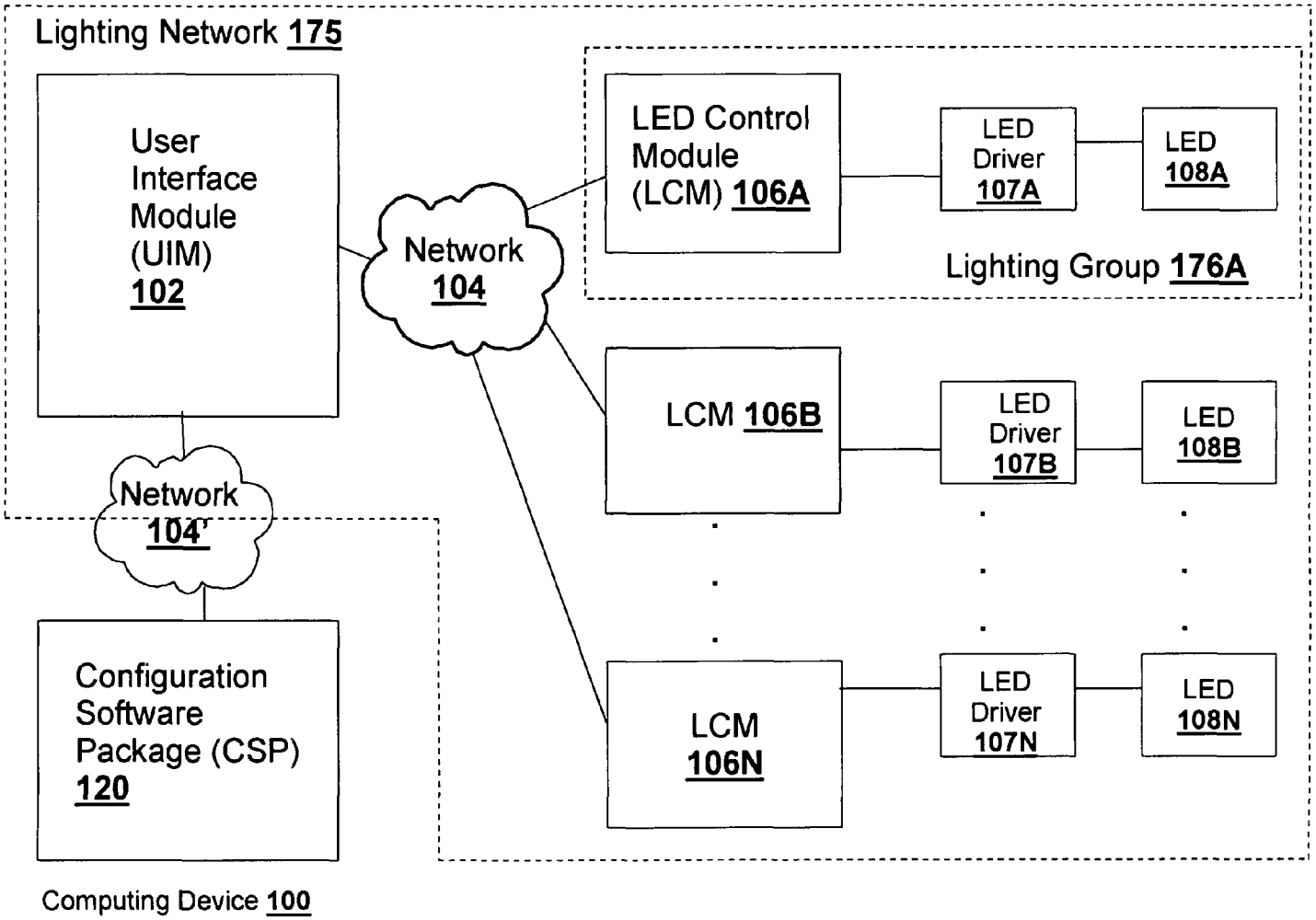
FIG. 1A is a block diagram that depicts an embodiment of a system environment and network for providing control and management of LEDs.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

For purposes of reading the description of the various embodiments of the present invention below, the following descriptions of the sections of the specification and their respective contents may be helpful:

- Section A describes a lighting network environment and computing environment useful for practicing an embodiment of the present solution;
- Section B describes embodiments of a user interface module (UIM) and LED control module (LCM) for managing and controlling LED devices; and
- Section C describes embodiments of a configuration software package for configuring the user interface module.
- Section D describes embodiments of methods for configuring and executing user specified rules to control lighting.

A. Lighting Network and Computing Environment

Prior to discussing the specifics of embodiments of the systems and methods of the LED control system and lighting network of the present solution, it may be helpful to discuss the network and computing environments in which such embodiments may be deployed. Referring now to FIG. 1A, an embodiment of a lighting network environment is depicted. In brief overview, a lighting network environment 175 includes one or more user interface modules (UIMs) 102 for controlling and managing one or more LED control modules (LCMs) 106A-106N (generally referred to as LCM 106). Each LED control module 106, in turn, may drive, control or manage an LED driver 107A-107N (generally referred to as LED driver 107) and a LED source 108A-108N (generally referred to as LED source 108). One or more LCMs 106A, LED Driver 107A and LED 108*a* may form a lighting group 176A or lighting sub-network. A configuration software package (CSP) 120 may be used to configure any of the logic, function or operations of the UIM 102 and/or LCM 106.

The lighting network 175 may include a plurality of network enabled devices, such as a network enabled UIM 102 communicating via a network 104 with one or more network enabled LCMs 106. As will be described in further detail below, each of these network enabled devices may have a network address for communicating with each other. Each of the network enabled UIMs 102 and LCMs 106A-106N may communicate via a wired and/or wireless network using any type and form of protocol. In some embodiments, the UIM and LCMs communicate over an Internet Protocol or Ethernet based network. In various embodiments, the lighting network 175 may be considered to include those lighting related devices in communication with each other to perform any of the functionality and operations described herein. As such, in some embodiments, the lighting network 175 includes the UIM 102 and one or more LCMs 106A-106N. In other embodiments, the lighting network 175 includes the UIM 102 and the LCM and any LED drivers 107A-107N and LEDs 108A-108N controlled and managed by the LCM and/or UIM. In yet another embodiment, the lighting network 175 includes the CSP 120 in communication with the UIM 102. In further embodiments, the lighting network includes the UIM 102, the CSP 120 and any LCMs 106A-106N.

The lighting network 175 may be established, organized, configured or arranged to have one or more lightings groups, such as lighting group 176A (generally referred to as a lighting group 176) as depicted in FIG. 1A. One or more LCMs 106A controlling an LED driver 107A and LED source 108A may be identified or organized into a lighting group 176. In some embodiments, a lighting group 176 includes a segment of a network 104. In other embodiments, the lighting group 176 is a sub-network of network 104. In yet other embodiments, a lighting group 176 includes a set of one or more lighting related devices logically grouped as a unit for control and management purposes. Although FIG. 1A depicts a lighting group 176 with one LCM 106A, one LED driver 107A and one LED 108A, a lighting group 176 may include a plurality of LCMs 106A-106N each controlling or managing one or more LED drivers 107A-107N and/or LED sources 108A-108N.

In the lighting network 175, the UIM 102 provides various interfaces, such as analog or digital interfaces, that may be configured to perform tasks, such as any lighting related task described herein. The UIM 102 receives input from these interfaces that influences or controls output to the LCM 106, which in turn controls and drives the LED drivers 107 and LED source 108. A first UIM 102 may communicate via a network 104 with and manage a plurality of LCMs 106A-106N. In some embodiments, a plurality of UIMs 102A-102N may be used to communicate with and manage a plurality of LCMs 106A-106N. In other embodiments, a first UIM 102A and a second UIM 102B may both communicate with and/or manage the same LCM 106 or set of LCMs 106A-106N. In one embodiment, a UIM 106 may be used to communicate and manage a lighting group 176.

The UIM 102 may also provide status, feedback or any other information about the operation and performance of the lighting network 175, or any portion thereof, such as a specific LCM or LED driver. For example, the UIM may present a web page via the network 104 to a user to determine the status of various operational aspects of the lighting network 175. The UIM 106 may include any monitoring and/or logging agents to detect and capture any activity of the operations and performance of the lighting network 175, or any portion thereof. In one embodiment, the UIM 102 provides information on the status of the network 104 between the UIM and any LCMs 106. In another embodiment, the UIM 102 provides information on the status of an LCM 106.

The LCM 106 provides a mechanism and means to interface digital controls and logic to a typical or otherwise "dumb" LED fixture 108. The LCM 106 receives input, commands or instructions from the UIM 102 and/or CSP 120 with respect to controlling, managing, driving or otherwise directing the operation of the LED driver 107 and corresponding LED source 108. The LCM 106 provides any type and form of output to transmit signals to a corresponding LED driver 107. The LCM 106 may include any type and form of communication interface, analog and/or digital, to communicate with an LED driver 107. In some embodiments, the LCM 106 may communicate with the LED driver 107 via any type and form of software communication interface, such as an application programming interface (API). In other embodiments, the LCM 106 may communicate with the LED driver 107 using any type and form of hardware interface.

An LCM 106 may communicate with one or more LED drivers 107. In some embodiments, a first LCM 106A communicates with a first LED driver 107A and a second LCM 106B communicates with a second LED driver 107B, and a third LCM 106C communicates with a third LED driver 107C, and so on. In other embodiments, a first LCM 106B communicates with a first LED driver 107A and a second LED driver 107B. In yet another embodiment, a first LCM 106A and a second LCM 106B are both used to communicate with one or more LED drivers 107. In some cases, a second LCM 106B may be used concurrently with a first LCM 106A for communicating with an LED driver 107. In other cases, the second LCM 106 may used as backup or a redundant LCM to the first LCM 106A for communicating with one or more LED drivers 107.

The LED driver 107 may include any type of logic, function or operation for controlling the current and/or power delivered to an LED source 108. The LED driver 107 may include software, hardware or any combination of software and hardware. In various embodiments, the LED driver 107 functions as an electronically-controlled current source providing a predetermined amount of current to one or more attached LED lighting modules 108 in response to received control signals. In one embodiment, the LED driver 107 acts as or provides a constant current power supply configured to provide a set current value to the LEDs despite the input voltage to the luminaire. For example, an Advance Transformer LED driver 107 may take a 120VAC input and provide a 350 mA constant current output whereas the current is controlled and the voltage is stepped down, a typical "buck" topology. In some cases, the LED driver 107 may "boost"

voltages in the case where the input voltage is lower than the forward voltage of the LEDs to be powered. In one case, the LED driver 107 may be configured as a "buck-boost" whereas the input voltage may be stepped up or stepped down as required. In some embodiments, these LED Drivers 107 offer dimming via a "PWM" (pulse width modulated signal), or analog control voltages including 0 to 10V control voltages. In other cases, the LED driver 107 may pulse the power input to the LED source on and off in order to adjust the intensity of the LED source 108.

The LED driver 107 may include a voltage-controlled current source, a current-controlled current source, a power MOSFET (Metal Oxide Semiconductor Field Effect Transistor), power amplifiers, power transistors, or high-current op-amps as well as resistive, capacitive and switching elements. In some embodiments, the LED driver includes current-limiting circuit elements at its output, so that current levels in excess of an LED's maximum rated value may not be exceeded. The driver 107 may include one or more input ports, e.g., a signal-control receiving port and an override control port, and one or more output ports, e.g., one or multiple signal output ports, a driver status port, and one or more current sensing ports. The LED driver 107 may receive and send pulse-width modulated signals, e.g., square wave signals with variable duty cycle. The input ports of the LED driver 107 may include over-voltage protection and surge protection to prevent damage by transient electrical fluctuations at its input ports.

In some embodiments, the LED driver 107 may be an ASIC (Application Specific Integrated Circuit), or a commercially produced, off-the-shelf LED driver chip. The driver 107 may be packaged in a housing, as a separate element of the lighting network 175, or may be incorporated into another element of the network or lighting group, e.g. into an LCM 106A or into an LED lighting assembly 108A. As an ASIC or commercially-available driver chip, the driver may be incorporated onto a printed circuit board (PCB) for custom-design or original-equipment manufacturing circuit applications. The LED driver 107 may have an external power supply, which powers internal circuitry in the driver and provides a source of amperage for the attached LEDs 108. The external power supply may be dedicated to the LED driver or shared with another element in the lighting network, e.g., an LCM.

In one embodiment, a first LED driver 107 communicates with or controls a single LED source 108. In other embodiments, a first LED driver 107A communicates with or controls a plurality of LED sources 108A-108N. In other embodiments, a first LED driver 107A communicates with or controls a first LED source 108A while a second LED driver 107B communicates with or controls a plurality of LED sources 108B-108N.

Examples of commercially-available LED drivers include an ADM8845 series LED driver chip, providing up to 30 mA current and connections for six LEDs, or an AD8240 series chip which must be used with an external transistor to provide sufficient drive current. Both of these driver chips are available from Analog Devices, Incorporated of Norwood, Mass. Other similar LED driver chips include: an FAN5607 LED driver chip, available from Fairchild Semiconductor Corporation of South Portland, Me., an STP16CP596 LED driver chip, available from STMicroelectronics of Lexington, Mass., or an LM27952 driver chip, available from National Semiconductor Corporation of Santa Clara, Calif. An example of a packaged LED driver includes an LEDD1 driver, available from Thorlabs of Newton, N.J., or a SmartDriver VDX driver, available from i2Systems of Morris, Conn.

The LED lighting source 108 may include any type and form of Lighting Emitting Diode (LED) based luminaire or luminaire source, such as an LED lighting assembly. In some embodiments, the LED 108 may comprise one or more semiconductor p-n junction light-emitting diodes. The LED assembly 108 may be constructed, designed or adapted to receive current from a LED driver 107 and direct the current across the one or more p-n junctions in forward bias. In various embodiments, the brightness or intensity of light output from a diode is substantially proportionally related to the amount of current flowing across the p-n junction. The LED source 108 may include resistors to limit current flow across the one or more diodes, and may include heat sinks in thermal contact with the diodes so as to dissipate from the diodes. Optical elements, such as lenses or diffusers may be placed over the LEDs to concentrate or disperse emitted light. Wavelength shifting methods, such as thin films containing organic fluorescent molecules or inorganic phosphorescent molecules, may be included with the diodes to absorb and re-emit radiation at wavelengths shifted from the LED's natural emission spectrum. The LED source 108 may include one or more diodes, each emitting radiation at distinct wavelengths, e.g. red, amber, green, and blue. In other embodiments, the LEDs may comprise organic light-emitting diodes (OLEDs) or phosphorescent light-emitting diodes (PHOLEDs) or a combination of LEDs, OLEDs and PHOLEDs. In some embodiments, the LEDs 108 within an assembly may be mounted on an electromechanically-moveable element, so that the direction of light output from the LED assembly may be controlled. In yet other embodiments, an LED driver 107 may be incorporated within the LED lighting assembly 108.

Examples of commercially-available LED lighting assemblies or LEDs include the VML lighting assembly series, the Apeiron SDi Tri-Light, the V-Line series lighting assemblies, all available from i2Systems of Morris, Conn. Additional examples include the Lumispot or LinkLED lighting assemblies, available from Dialight Corporation of Farmingdale, N.J. or the Titan LED Light Engines available from Lamina of Westamptom, N.J. Alternatively, examples of individual LEDs include the ASMT series light sources, available from Avago Technologies of Andover, Mass.

Still referring to FIG. 1A, the network 104 may be any type and/or form of network and may include any of the following: a point to point network, a broadcast network, a wide area network, a local area network, a telecommunications network, a data communication network, a computer network, an ATM (Asynchronous Transfer Mode) network, a SONET (Synchronous Optical Network) network, a SDH (Synchronous Digital Hierarchy) network, a wireless network and a wireline network. In some embodiments, the network 104 may comprise a wireless link, such as an infrared channel or satellite band. The topology of the network 104 may be a bus, star, or ring network topology. The network 104 and network topology may be of any such network or network topology as known to those ordinarily skilled in the art capable of supporting the operations described herein.

Although FIG. 1A shows a network 104 and network 104' (generally referred to as network(s) 104) between the UIM 102 and the LCMs 106 or CSP 120 the UIM 102, LCMs 106 and/or CSP may be on the same network 104. The networks 104 and 104" can be the same type of network or different types of networks. The network 104 may be a local-area network (LAN), such as a company Intranet, a metropolitan area network (MAN), or a wide area network (WAN), such as the Internet or the World Wide Web. The networks 104, 104' may be a private or public network. In one embodiment, network 104' or network 104" may be a private network and network 104 may be a public network. In some embodiments, network 104 may be a private network and network 104 a public network. In another embodiment, networks 104, 104' may be private networks.

Figure 1B:
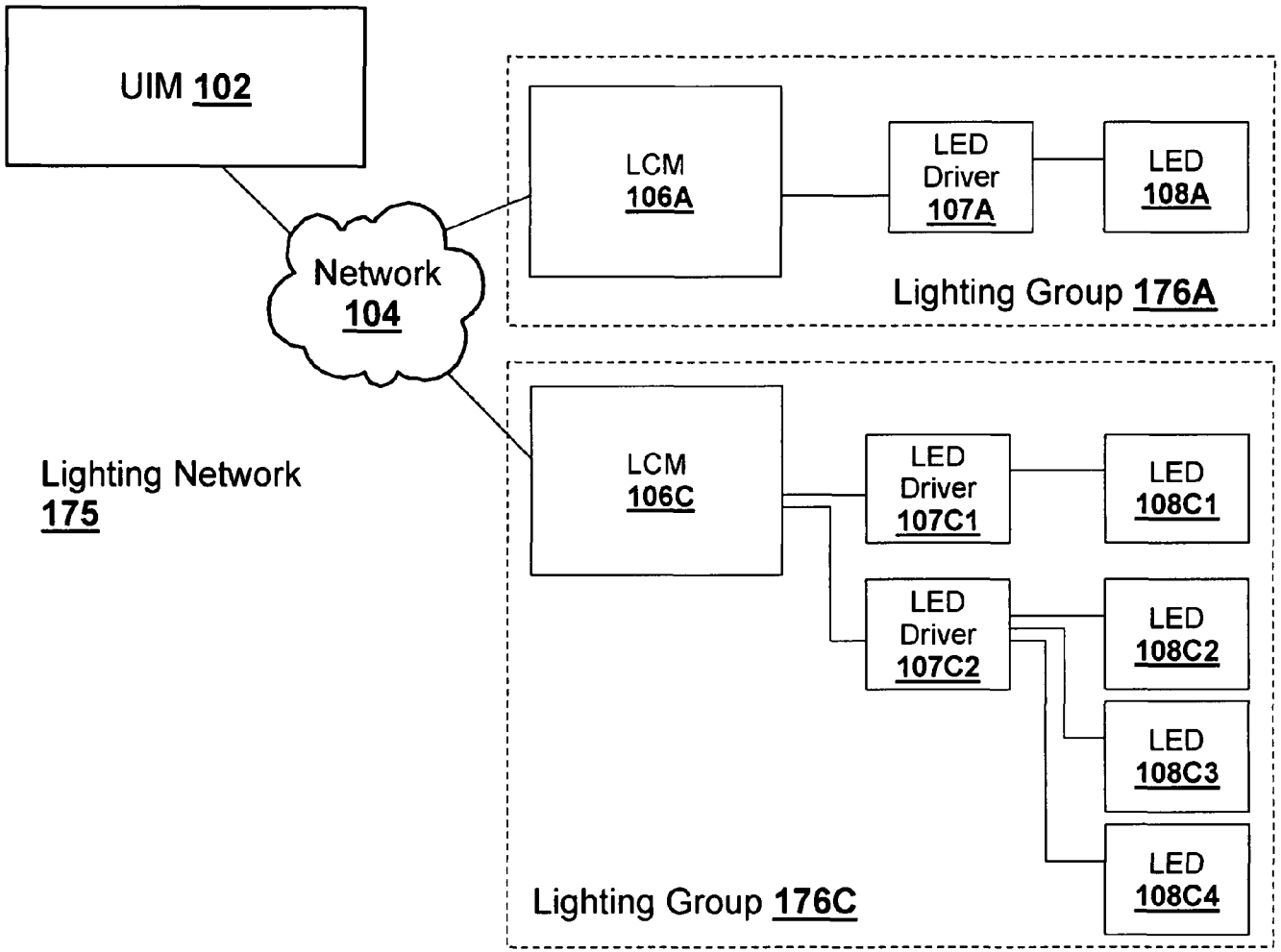
FIG. 1B is a block diagram that depicts another embodiment of an environment and network for providing subgroups or sub-networks referred to as lighting groups.

Referring now to FIG. 1B, an example embodiment of a lighting network 175 with a plurality of lighting groups 176A-176C is depicted. In brief overview, the lighting network 175 includes a first lighting group 176A having a first LCM 106A controlling a first LED driver 107A that is driving an LED source 108A. The lighting network 175 also includes a second lighting group 176C. In this lighting group 176C, a second LCM 106C controls a plurality of LED Drivers 107C1-107C2, which in turn each drive a plurality of LED sources 108C1-108C4. The first LED driver 107C1. The LED driver 107C1 of this lighting group drives a single LED source 108C1. Another LED driver 107C2 of this lighting group drives a plurality of LED sources 108C2-108C4. The UIM 102 may be used to manage the lighting groups 176A-176C.

Although FIG. 1B depicts an arrangement of lighting groups in the lighting network 175, the lighting network 175 may include any arrangement, combination or grouping of LCMs 106, LED Drivers 107 and LED sources 108 in either lighting groups or not in lighting groups. In some cases, a first UIM 102 may manage a first lighting group and a second UIM a second lighting group. In another case, a UIM may manage one or more LCMs not identified or logically organized into a lighting group.

Figure 1C:
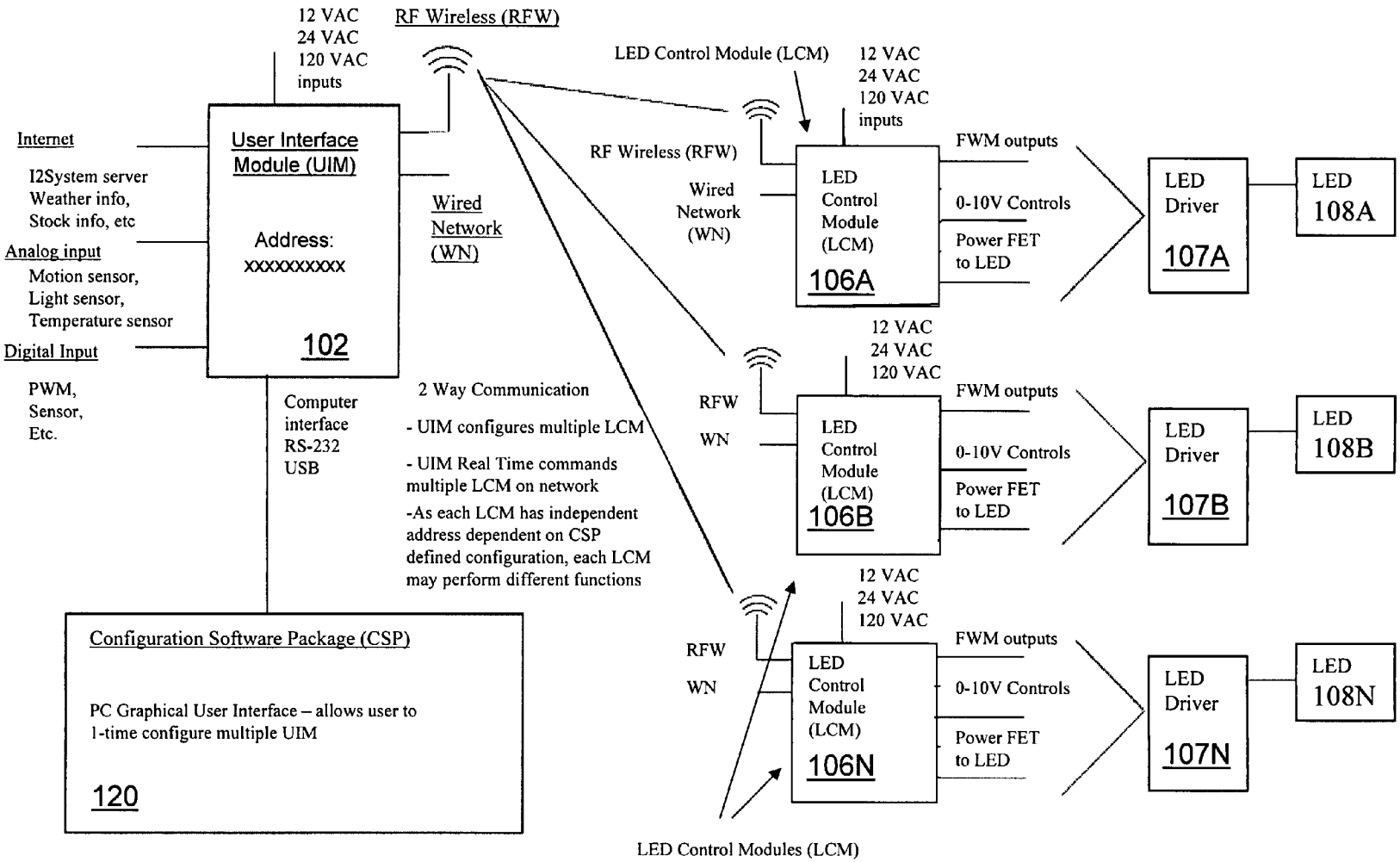
FIG. 1C is a block diagram that depicts an embodiment of a lighting network system as depicted in FIG. 1A.

Referring now to FIG. 1C, an example embodiment of a lighting network 175 is depicted. In brief overview, a UIM 102 may communicate over a network 104 to LCMs 106A-106N which in turn controls one or more LED drivers 107A-107N driving one or more LED sources 108A-108N. This example embodiment of the lighting network 175 will be used herein as a reference for further describing the elements therein. As described in more detail in Section B below and in conjunction with FIG. 2A, the UIM 102 may include a plurality of analog, digital and Internet based inputs to influence or control output, commands or instructions to an LCM 106. As described in more detail in Section B below and in conjunction with FIG. 2B, the LCM 106 may receive input from a UIM via the network 104 to control output to a LED driver 107. As described in more details in Section C below and in conjunction with FIGS. 3A-3N, the CSP 120 may used to configure the logic, function and operation of the UIM 102 in controlling and managing the lighting network 175 via the LCMs 106.

Computing Device

The configuration software package (CSP) 120 may be deployed as and/or executed on any type and form of computing device 100, such as a computer, network device or appliance capable of communicating on any type and form of network and performing the operations described herein. In some embodiments, any of the functionality, operations or logic of the UIM 102, LCM 106, LED Driver 107 and/or LED 108 described herein may be supported by, configured via, performed by or deployed on a computing device 100. In other embodiments, any portion of the UIM 102, LCM 106, LED Driver 107 and/or LED 108 may include or comprise any portion of the computing device 100 described below.

Figure 1D:
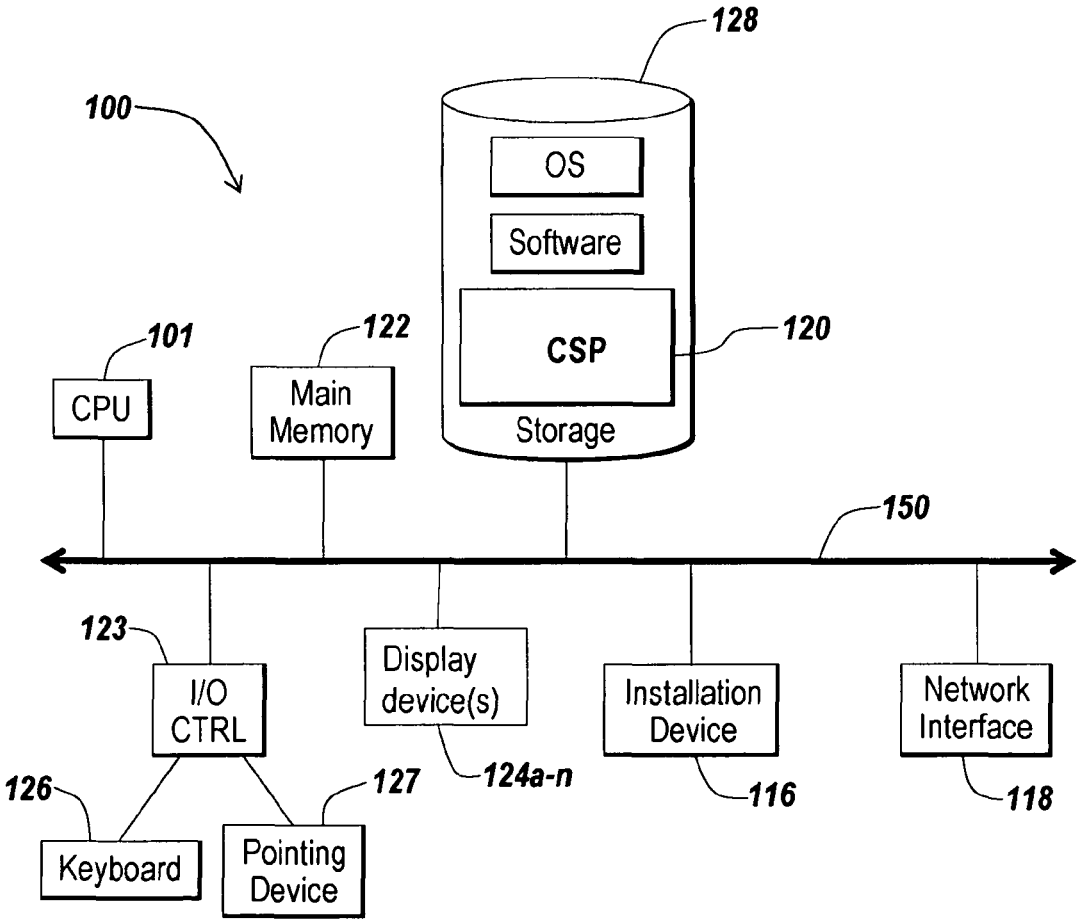
FIGS. 1D and 1E are block diagrams of an embodiment of a computing device useful in an embodiment of a solution provided by the present application.
Figure 1E:
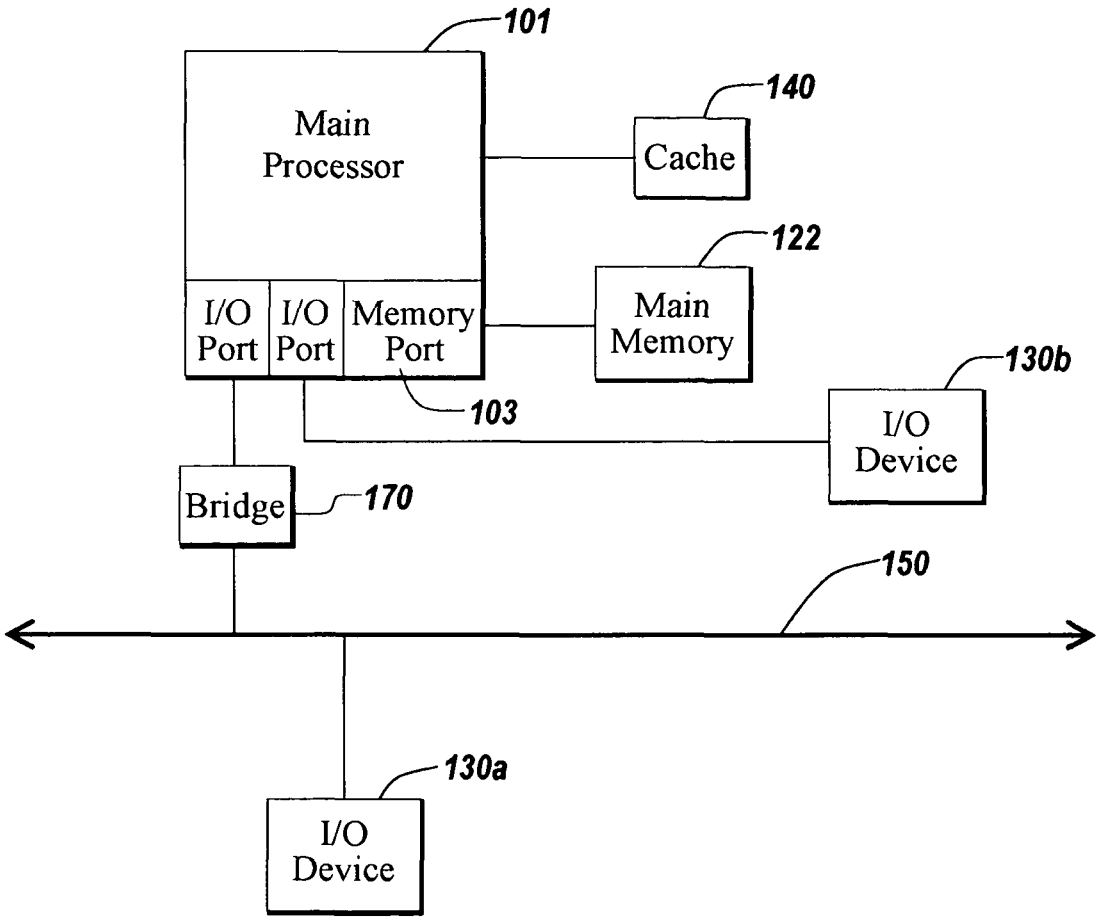

FIGS. 1D and 1E depict block diagrams of a computing device 100 useful for practicing an embodiment of the client 102, server 106 or appliance 200. As shown in FIGS. 1D and 1E, each computing device 100 includes a central processing unit 101, and a main memory unit 122. As shown in FIG. 1D, a computing device 100 may include a visual display device 124, a keyboard 126 and/or a pointing device 127, such as a mouse. Each computing device 100 may also include additional optional elements, such as one or more input/output devices 130*a*-130*b* (generally referred to using reference numeral 130), and a cache memory 140 in communication with the central processing unit 101.

The central processing unit 101 is any logic circuitry that responds to and processes instructions fetched from the main memory unit 122. In many embodiments, the central processing unit is provided by a microprocessor unit, such as: those manufactured by Intel Corporation of Mountain View, Calif.; those manufactured by Motorola Corporation of Schaumburg, Ill.; those manufactured by Transmeta Corporation of Santa Clara, Calif.; the RS/6000 processor, those manufactured by International Business Machines of White Plains, N.Y.; or those manufactured by Advanced Micro Devices of Sunnyvale, Calif. The computing device 100 may be based on any of these processors, or any other processor capable of operating as described herein.

Main memory unit 122 may be one or more memory chips capable of storing data and allowing any storage location to be directly accessed by the microprocessor 101, such as Static random access memory (SRAM), Burst SRAM or Synch-Burst SRAM (BSRAM), Dynamic random access memory (DRAM), Fast Page Mode DRAM (FPM DRAM), Enhanced DRAM (EDRAM), Extended Data Output RAM (EDO RAM), Extended Data Output DRAM (EDO DRAM), Burst Extended Data Output DRAM (BEDO DRAM), Enhanced DRAM (EDRAM), synchronous DRAM (SDRAM), JEDEC SRAM, PC100 SDRAM, Double Data Rate SDRAM (DDR SDRAM), Enhanced SDRAM (ESDRAM), SyncLink DRAM (SLDRAM), Direct Rambus DRAM (DRDRAM), or Ferroelectric RAM (FRAM). The main memory 122 may be based on any of the above described memory chips, or any other available memory chips capable of operating as described herein. In the embodiment shown in FIG. 1D, the processor 101 communicates with main memory 122 via a system bus 150 (described in more detail below). FIG. 1D depicts an embodiment of a computing device 100 in which the processor communicates directly with main memory 122 via a memory port 103. For example, in FIG. 1E the main memory 122 may be DRDRAM.

FIG. 1E depicts an embodiment in which the main processor 101 communicates directly with cache memory 140 via a secondary bus, sometimes referred to as a backside bus. In other embodiments, the main processor 101 communicates with cache memory 140 using the system bus 150. Cache memory 140 typically has a faster response time than main memory 122 and is typically provided by SRAM, BSRAM, or EDRAM. In the embodiment shown in FIG. 1D, the processor 101 communicates with various I/O devices 130 via a local system bus 150. Various busses may be used to connect the central processing unit 101 to any of the I/O devices 130, including a VESA VL bus, an ISA bus, an EISA bus, a MicroChannel Architecture (MCA) bus, a PCI bus, a PCI-X bus, a PCI-Express bus, or a NuBus. For embodiments in which the I/O device is a video display 124, the processor 101 may use an Advanced Graphics Port (AGP) to communicate with the display 124. FIG. 1E depicts an embodiment of a computer 100 in which the main processor 101 communicates directly with I/O device 130 via HyperTransport, Rapid I/O, or InfiniBand. FIG. 1E also depicts an embodiment in which local busses and direct communication are mixed: the processor 101 communicates with I/O device 130 using a local interconnect bus while communicating with I/O device 130 directly.

The computing device 100 may support any suitable installation device 116, such as a floppy disk drive for receiving floppy disks such as 3.5-inch, 5.25-inch disks or ZIP disks, a CD-ROM drive, a CD-R/RW drive, a DVD-ROM drive, tape drives of various formats, USB device, hard-drive or any other device suitable for installing software and programs such as the CSP 120, or portion thereof. The computing device 100 may further comprise a storage device 128, such as one or more hard disk drives or redundant arrays of independent disks, for storing an operating system and other related software, and for storing application software programs such as any program related to the CSP 120. Optionally, any of the installation devices 116 could also be used as the storage device 128. Additionally, the operating system and the software can be run from a bootable medium, for example, a bootable CD, such as KNOPPIX®, a bootable CD for GNU/Linux that is available as a GNU/Linux distribution from knoppix.net.

Furthermore, the computing device 100 may include a network interface 118 to interface to a Local Area Network (LAN), Wide Area Network (WAN) or the Internet through a variety of connections including, but not limited to, standard telephone lines, LAN or WAN links (e.g., 802.11, T1, T3, 56 kb, X.25), broadband connections (e.g., ISDN, Frame Relay, ATM), wireless connections, or some combination of any or all of the above. The network interface 118 may comprise a built-in network adapter, network interface card, PCMCIA network card, card bus network adapter, wireless network adapter, USB network adapter, modem or any other device suitable for interfacing the computing device 100 to any type of network capable of communication and performing the operations described herein.

A wide variety of I/O devices 130*a*-130*n* may be present in the computing device 100. Input devices include keyboards, mice, trackpads, trackballs, microphones, and drawing tablets. Output devices include video displays, speakers, inkjet printers, laser printers, and dye-sublimation printers. The I/O devices 130 may be controlled by an I/O controller 123 as shown in FIG. 1D. The I/O controller may control one or more I/O devices such as a keyboard 126 and a pointing device 127, e.g., a mouse or optical pen. Furthermore, an I/O device may also provide storage 128 and/or an installation medium 116 for the computing device 100. In still other embodiments, the computing device 100 may provide USB connections to receive handheld USB storage devices such as the USB Flash Drive line of devices manufactured by Twintech Industry, Inc. of Los Alamitos, Calif.

In some embodiments, the computing device 100 may comprise or be connected to multiple display devices 124*a*-124*n*, which each may be of the same or different type and/or form. As such, any of the I/O devices 130*a*-130*n* and/or the I/O controller 123 may comprise any type and/or form of suitable hardware, software, or combination of hardware and software to support, enable or provide for the connection and use of multiple display devices 124*a*-124*n* by the computing device 100. For example, the computing device 100 may include any type and/or form of video adapter, video card, driver, and/or library to interface, communicate, connect or otherwise use the display devices 124*a*-124*n*. In one embodiment, a video adapter may comprise multiple connectors to interface to multiple display devices 124*a*-124*n*. In other embodiments, the computing device 100 may include multiple video adapters, with each video adapter connected to one or more of the display devices 124*a*-124*n*. In some embodiments, any portion of the operating system of the computing device 100 may be configured for using multiple displays 124*a*-124*n*. In other embodiments, one or more of the display devices 124*a*-124*n* may be provided by one or more other computing devices, such as computing devices 100*a* and 100*b* connected to the computing device 100, for example, via a network. These embodiments may include any type of software designed and constructed to use another computer's display device as a second display device 124*a* for the computing device 100. One ordinarily skilled in the art will recognize and appreciate the various ways and embodiments that a computing device 100 may be configured to have multiple display devices 124*a*-124*n*.

In further embodiments, an I/O device 130 may be a bridge 170 between the system bus 150 and an external communication bus, such as a USB bus, an Apple Desktop Bus, an RS-232 serial connection, a SCSI bus, a FireWire bus, a FireWire 800 bus, an Ethernet bus, an AppleTalk bus, a Gigabit Ethernet bus, an Asynchronous Transfer Mode bus, a HIPPI bus, a Super HIPPI bus, a SerialPlus bus, a SCI/LAMP bus, a FibreChannel bus, or a Serial Attached small computer system interface bus.

A computing device 100 of the sort depicted in FIGS. 1D and 1E typically operate under the control of operating systems, which control scheduling of tasks and access to system resources. The computing device 100 can be running any operating system such as any of the versions of the Microsoft® Windows operating systems, the different releases of the Unix and Linux operating systems, any version of the Mac OS® for Macintosh computers, any embedded operating system, any real-time operating system, any open source operating system, any proprietary operating system, any operating systems for mobile computing devices, or any other operating system capable of running on the computing device and performing the operations described herein. Typical operating systems include: WINDOWS 3.x, WINDOWS 95, WINDOWS 98, WINDOWS 2000, WINDOWS NT 3.51, WINDOWS NT 4.0, WINDOWS CE, and WINDOWS XP, all of which are manufactured by Microsoft Corporation of Redmond, Wash.; MacOS, manufactured by Apple Computer of Cupertino, Calif.; OS/2, manufactured by International Business Machines of Armonk, N.Y.; and Linux, a freely-available operating system distributed by Caldera Corp. of Salt Lake City, Utah, or any type and/or form of a Unix operating system, among others.

In other embodiments, the computing device 100 may have different processors, operating systems, and input devices consistent with the device. For example, in one embodiment the computer 100 is a Treo 180, 270, 1060, 600 or 650 smart phone manufactured by Palm, Inc. In this embodiment, the Treo smart phone is operated under the control of the PalmOS operating system and includes a stylus input device as well as a five-way navigator device. Moreover, the computing device 100 can be any workstation, desktop computer, laptop or notebook computer, server, handheld computer, mobile telephone, any other computer, or other form of computing or telecommunications device that is capable of communication and that has sufficient processor power and memory capacity to perform the operations described herein.

B. User Interface Module (UIM) and LED Control Module (LCM)

Figure 2A:
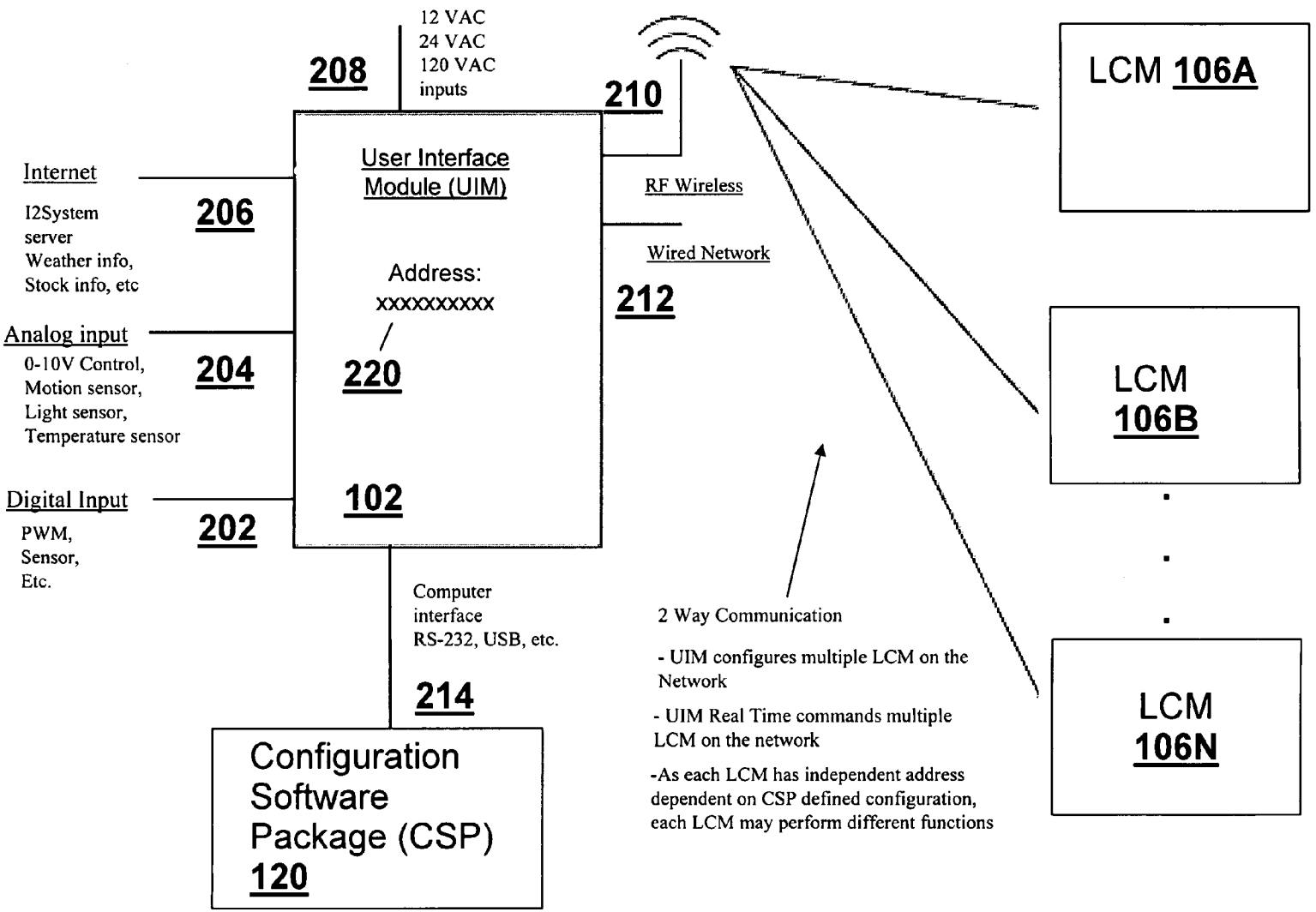
FIG. 2A is a block diagram of an embodiment of a User Interface Module (UIM)

Referring now to FIG. 2A, an embodiment of a User Interface Module (UIM) 102 is depicted. In brief overview, the UIM 102 may be used to control one of more LED control modules 106A-106B. The UIM may have one or more types of data inputs, such as a digital input 202, analog input 204, internet input 206, and computer interface input 214. The UIM 102 may be electrically powered through a power-supply port 208, and may have one or more types of data output ports, such as a wireless RF network port 210 and a wired network port 212. In brief, lighting-control instructions, or rules, may be defined and selected in the CSP 120, and then downloaded and programmed into the UIM via computer interface 214. The UIM relays the lighting control instructions to one or more LCMs existing within the lighting network 175. The UIM 102 may have an electronically-recognized, unique address 220 which distinguishes it from similar UIMs within a lighting network or in close proximity to a lighting network. Communication between the UIM and one or more LCMs may be via a wired network or wireless network. The instructions transmitted from the UIM 102 to the LCM 106 operationally program the LCM according to a desired lighting control scheme. After receiving instructions from the UIM 102, the one or more LCMs 106A-106B may operate independently or in concert, as defined in the provided instruction set, to control one or more LED drivers 107 connected to the LCMs 106. The LED drivers 107 then provide electrical current to attached LEDs 108 to control their light output.

In overview, the UIM 102 may include an electronic device designed, constructed or adapted to receive data and output electronic signals in response to the received data. The UIM 102 may include any preprogrammed instructions or rules associated with the received data. In some cases, the UIM 102 may be programmable. The various data interfaces 202, 204, 206 and 214 may be used to adapt or operationally program the UIM 102 to execute specific lighting-control tasks. For example, executable code or instructions may be programmed into the UIM 102 using the CSP 120 and computer interface port 214. Data received from ports 202, 204 and 206 may affect the operational results of the executable code, and change the electronic signals output to the LED drivers 107 at ports 210 and 212.

In some embodiments, the UIM 102 may include a reduced instruction set computer (RISC), programmable logic controller (PLC), microprocessor, microcontroller (MCU), application specific integrated circuit (ASIC), digital signal processor (DSP), or a combination of these hardware components. Any one of these components, or combination thereof, may serve as a central processor or central controller for the UIM. The central processor or controller may be adapted to receive and execute computer code such as C, C++, RISC instruction sets, Basic, assembly language, programming language for microcontrollers, Java, or vendor proprietary machine language code. The UIM may further include peripherals such as analog-to-digital converters (ADC), digital-to-analog converters (DAC), various types of memory such as RAM, ROM, DRAM, SRAM, EPROM, EEPROM, Flash Memory, or Cache, and various types of serial communications interfaces such as inter-integrated circuit (I2C) or serial peripheral interface (SPI) bus. In various embodiments, the UIM 102 is electrically powered through a power port 208 with a local power supply. The UIM 102 further includes one or more interface ports, e.g. computer interface port 214, digital input port 202, analog input port 204, and internet port 206, and one or more output ports, e.g. a radio-frequency port 210, and network port 212.

In other embodiments, the UIM 102 may be a computing device 100 such as a personal computer or a laptop. The configuration software package 120 may then be executed on the UIM 102 in some embodiments, and data transmitted to the LCMs through a network port, such as a wireless connector.

In yet other embodiments, the UIM 102 may be comprised of fixed, i.e. non software-programmable, electronic circuitry. For example, the UIM may comprise any combination of TTL (Transistor-Transistor Logic), logic chips, resistors, capacitors, potentiometers, field-effect transistors (FETs), transistors, switches, jumpers, and op-amp chips mounted on a printed circuit board (PCB). In these embodiments, functionality of the UIM may be reprogrammed by changing circuit elements.

In various embodiments, the UIM 102 may be small in size, measuring less than 10 cm along any edge. The UIM may be constructed on a small, custom printed circuit Board (PCB) and enclosed in an electronic housing. The housing may provide shielding from electromagnetic interference EMI, and provide a panel for data port connections. In other embodiments, the UIM may be designed and constructed as any type and form of appliance, any type and form of peripheral, such as a USB device, or in any form factor of a computing device 100, or portion thereof, such as a card. As those ordinarily skilled in the art will appreciate, the form of the UIM may be designed and constructed for many environments and have a size and form factor in accordance with such environments.

Computer interface port 214 may be used to program the UIM's internal processor. The port 214 may include a single or multiwire connection adapted to support communications between an external processor, such as a personal computer, laptop computer or any portable computing device adapted to run the configuration software package 120, and the UIM's internal processor or electronics. The external computer may be one that supports any of the following operating systems: Windows, Mac OS, Unix, and Linux. Serial or parallel communication protocols may be employed over port 214. The communications protocols employed over port 214 may include, without limitation, RS-232, RS-485, modbus, Ethernet, IEEE 802.3, USB, SCSI, FireWire, ATM, TCP, UDP, ZigBee, Bluetooth and AppleTalk. In other embodiments, computer interface port 214 may be a wireless port supporting, e.g., IEEE 802.11 wireless communication protocols or Bluetooth technology. In yet another embodiment, the computer interface may include any type and form of network interface or Network Interface Card for communicating with a computing device 100 over a network 104.

As shown in FIG. 2A, power is supplied to the UIM 102 through power-supply port 208. Electronic power delivered to the UIM may be in the form of alternating voltage and current, e.g. VAC, 24 VAC, or 120 VAC, or in the form of direct voltage and current, e.g. 5 VDC, 9 VDC, 12 VDC, or 24 VDC. The power may be provided from a wall-mounted power supply, or from existing facility supplies, e.g. 120 VAC. In various embodiments, the power supply chord may be hard-wired to the UIM, or may be removably attached via a power jack to the LCM. In alternative embodiments, power may be provided by a battery, which may be mounted external to the LCM or incorporated into the LCM unit.

In various embodiments, the UIM 102 includes one or more digital ports 202. The digital ports 202 may be adapted to receive various digital signals, such as TTL, CMOS and ECL (emitter coupled logic) signals, which may be representative of the state of an external element or condition. In some embodiments, the input impedance of the digital ports 202 is high, greater than about 1,000 ohms so that low-current signals may be detected. In other embodiments where high-speed digital signals are input to the UIM, the input impedance at the digital port 202 may be low, e.g. less than about 100 ohms. Field effect transistors (FETs), bipolar junction transistors (BJTs), logic chips or digital-to-analog converters (DACs) may be employed as signal-receiving circuit elements at the digital input ports. Voltages appearing on the digital ports may range from about −5 volts to about 24 volts in various embodiments.

Signals applied to the digital input ports may be derived from a variety of sources including, but not limited to, a pulse-width modulation (PWM) source, toggle switches, jumper pins, sensors with digital output, a computer, another UIM, an ASIC, or an LED control module 106. In some embodiments, the logic level of one or more digital ports 202 may determine the manner in which code programmed into the UIM's controller is executed. For example, a logic level of "1" appearing at a particular digital input port may initiate the execution of a subroutine within the controller's code. In additional embodiments, the logic level appearing at a port may be, in effect, passed to an LCM. For example, a PWM signal applied to a digital port may be relayed to an LCM to control the intensity of an LED. The logic level of the digital ports may be monitored continuously by the UIM's controller, or monitored only upon conditions established by executable code within the controller. For example, the signal level of one digital port may only be sampled pending the status of a signal level at another digital port or analog port. In some embodiments, the logic level of one or more ports may be set manually via toggle switches or jumper pins.

In various embodiments, the UIM 102 includes one or more analog ports 204. The analog inputs are useful for monitoring continuously-varying state conditions, e.g. environmental temperature, humidity, pressure, wind speed, wind direction, ambient light level, motion, speed, proximity, fluid flow, and acoustic amplitude. Analog signals from sensors adapted to monitor such continuously-varying conditions may be applied to one or more of the UIM's analog ports 204. In additional embodiments, user-supplied control signals, e.g. a 0-10 V control signal or a control signal derived from a conventional light dimmer, may be applied to the analog input ports. Analog ports with low impedance, e.g. less than about 100 ohms, may be included in the UIM 102 for high-speed signals, and ports with high impedance, greater than about 1,000 ohms, may be included for low-level signals.

Operational amplifiers (op-amps) may be employed as signal-receiving circuit elements for the analog ports 204. The signal level of the analog ports 204 may be monitored continuously by the UIM's controller, or monitored only upon conditions established by executable code within the controller. In some embodiments, the signal level appearing on an analog port 204 may be, in effect, passed by the UIM's controller to an LED control module. For example, the percentage of relative humidity may be monitored by an electronic sensor, and its output applied at an analog port 204 and relayed to an LCM to control the blue-intensity component of a yellow-blue LED lighting combination. In additional embodiments, the signal level appearing at an analog port may trigger, as in a threshold-detection application, the execution of a subroutine within the controller's code. For example, a sensed temperature in excess of a predefined level, may initiate the execution and transmission of a section of controller code which causes flashing of red LEDs.

The UIM 102 may include an Internet port 206, adapted for communication with any type and form of device via the Internet. These devices may exist within a personal area network (PAN), local area network (LAN), campus area network (CAN), metropolitan area network (MAN), wide-area network (WAN), or the Internet. Examples of data that may be received by the UIM through the internet port 206 include, but are not limited to, room occupancy, local weather conditions, remote weather conditions, traffic flow, metropolitan power flow, Stock Exchange information, number of website hits, and rate of online orders. The Internet port 206 may be a wired or wireless Ethernet port adapted to support any of a variety of network or Interface protocols. In some embodiments, the Internet port 206 may include any type and form of Network Interface Card for communicating on a network 104. The Internet port 206 may include or interface to a network stack, such as a TCP/IP (transport control protocol/Internet protocol) stack.

The UIM 102 may include any type and form of address 220 or addressing scheme for identifying or communicating with or from the UIM 102. An electronically-recognized address 220 may be pre-assigned to the UIM or dynamically configured. In some embodiments, the address 220 may be hard-wired during manufacture of the UIM. In other embodiments, the address may be set upon installation using a dual in-line package (DIP) switch incorporated into the UIM. In other embodiments, the UIM's address may be set by a lighting network system administrator accessing address configuration via ports 214 or 206. In yet other embodiments, the UIM's address may be dynamically configured via dynamic host configuration protocol (DHCP). In one embodiment, the address 220 is an Internet Protocol (IP) address. In other embodiments, the address 220 is a Media Access Control (MAC) address. In some embodiments, the address 220 is an Ethernet Protocol address. In yet one embodiment, the scheme or encoding of the address 200, or any portion thereof, may identify the manufacturer of the UIM or any functionality of the UIM.

In various embodiments, the UIM 102 may include one or more radio-frequency (RF) wireless network ports 210 and/or one or more wired network ports 212. In various embodiments, the ports 210 and 212 are used for bidirectional communication between the UIM and one or more LCMs 106A-106N. In some embodiments, the UIMs and LCMs communicate via wireless RF signals. Communications protocols used between the UIM and LCMs may be any of a variety of established Internet or industry protocols, e.g. IEEE 802.11, or may be a proprietary protocol developed by the manufacturer. In one embodiment, the ports may include commercial off-the-shelf Ethernet port hardware. In other embodiments, the ports may include one or more application-specific integrated circuits (ASICs) designed to support a selected communication protocol.

Communication between the UIM and LCM may be secure, encrypted or authenticated in either direction or in both directions. In some embodiments, the LCM only recognizes or acknowledges data transmitted by a pre-specified UIM. For example, a unique product identity code may be assigned to each UIM by the manufacturer, and this unique code may accompany each data transmission from the UIM to the LCMs. The LCMs, programmed to accept data accompanied by the unique code, may then authenticate the data transmission and process the instructions issued by the UIM. Such authentication would prevent other nearby UIMs from inadvertently seizing control of the LCMs. The two-way communication between the UIM and LCM may then be used to configure the one or more LCMs on the lighting network for desired lighting operations, or to relay real-time commands, such as changes in states at the UIM's digital 202, analog 204 or Internet 206 interface ports, from the UIM to one or more LCM's.

In operation, the UIM 102 may be installed, in some embodiments, at a location along with one or more LCMs 106A-106B. The LCMs are located within RF range of the UIM, or are electronically connected to the UIM via wires connecting ports 212 on the UIM to ports 212A on the LCMs. Attached to each LCM is one or more LED drivers 107 and one or more LED lighting assemblies 108. Any desired sensed or control signals, digital and analog, are connected to data ports 202 and 204. Optionally, an internet connection is established at port 206. Once installed, the UIM is powered on through port 208. Desired lighting instructions or rules, in the form of executable code, are then downloaded to the UIM's internal processor via ports 214 or 206. The executable code may provide for monitoring and incorporation of data appearing at data ports 202, 204 and 206. For example, weather conditions may be monitored over the internet port 206, and audio signals may be monitored over analog port 204, and these inputs reflected in data output from the UIM's processor. The code is executed in the UIM 102, and results are transmitted as instructions to the LCMs 106A-106N in the lighting network 175. Each LCM then executes the received instructions to control lighting within its lighting group 176. The instructions received by the LCMs may affect one or more of several lighting parameters, e.g. lighting intensity, lighting color, rate of change of lighting intensity, rate of change of lighting color, rate of repetitive change in lighting color, and rate of repetitive change in lighting intensity. In this manner, dynamic visual lighting displays can be created and readily modified.

In operation, the UIM may provide various interfaces that may be configured to enable specific LED lighting tasks which are executed over the lighting network 175. These tasks may be preset by an OEM customer, or may be set upon installation of the UIM, LCM and LED devices. Interfaces to the UIM may be analog or digital.

In some embodiments, an analog interface may include an on/off switch, a potentiometer, a light sensor, a proximity sensor, a temperature sensor, an adjustable or constant voltage, or a conventional SCR type dimmer switch such as those readily available off the shelf at most large retailers, e.g. Home Depot, Lowes, etc. In various embodiments, the analog interface may trigger an event within the UIM such that rules may be executed to produce a desired lighting effect. By way of example, upon receiving a temperature input corresponding to 50 degrees C., on or more LCMs may signal an increase in LED current output to 80% intensity. In another example, upon engaging a conventional toggle switch, on or more LCMs may signal an increase in LED current with a linear fade up to 100% over 3 seconds. In another example, a UIM may be configured to receive a 0 V to 10 V analog input such that a 1 V input produces an LED light output of 0% and a 9 V input yields a light output of 100%, with any intervening voltage producing a linearly proportional light output. Additionally in this example for voltages greater than 9 V, one or more LCMs may provide various PWM outputs to be engaged, each PWM output controlling an LED driver operatively communicating with different color LEDs, e.g. red, green, blue, and the LEDs may strobe and flash to create a lightening effect of varying intensity and on/off duration. Another example mode of operation may include sequencing multiple LCM's respective outputs on and off with various dimming curves, such that a light show may be created within a lighting space, including configurations such as light color and/or intensity chasing effects.

In other modes of operation, digital inputs to the UIM may affect various LED lighting dynamics. The UIM may be connected to a local area network (LAN) having Internet access, and may have an IP address, e.g. static or assigned via dynamic host configuration protocol (DHCP). The UIM may receive digital data through the network, e.g. the UIM may be configured to receive internet data from its manufacturer's servers or to receive local temperature data. By way of example, when the received temperature signal corresponds to −20 C or colder, an LCM activates a blue LED, and when the temperature data indicates 40 C or hotter, the LCM activates a red LED, and any temperature in between shall be a mixture or graduated shade between blue and red. In some embodiments, a UIM may be assigned to control an LCM having three PWM signal outputs, controlling light out put from one or more red, green, and blue LEDs. In this embodiment color mixing is enabled by controlling the PWM signals delivered to each of the three LEDs. In some embodiments, digital interfaces may be serial or parallel network type interfaces.

Although a UIM 102 is shown with specific ports in FIG. 2A, other embodiments may have more or less ports to the UIM, as well as provide multiple ports of any kind. For example, another embodiment of the UIM may exclude a network port 212, and include additional analog input ports 204 and additional digital input ports 212. In other embodiments, the UIM may provide multiple RF wireless ports 210. In yet other embodiments, one wireless network port may be adapted to provide all the functionality of ports 206, 210, 212, and 214, such that these four ports are replaced by a single network interface port. In various embodiments, the interface ports on the UIM may be configured and recognized via software or firmware loaded onto the UIM's internal processor or controller. For example, a UIM may be configured with two terminal blocks of which an end user may connect a temperature sensor, proximity sensor, light sensor, on/off switch, PWM signal, etc., and the UIM may be configured via the CSP in such a way that types of signal inputs are known prior to their connection.

Although described as "input" and "output" ports, data ports on the UIM may be adapted, constructed or designed to be bidirectional. For example, the computer interface port 214, the digital ports 202, the analog ports 204, the Internet port 206, the RF port 210 and network port 212 may be adapted to transmit and receive data. To receive data through any UIM port in various embodiments, the UIM provides for the port and its associated internal electronics to change their state from transmit mode to "listen" mode. In listen mode, any signal appearing on the port may be directed to the UIM's processor, or to a peripheral data-storage buffer or cache for subsequent processing.

Although programming of the UIM's internal processor or internal electronics has been described as enacted over computer interface port 214, in various embodiments programming of the UIM's internal processor may also occur via the Internet port 206. For example, new application software, such as software developed by the UIM manufacturer, may be downloaded over the Internet, through port 206 and programmed into the UIM's processor. In this manner, any improvements to the operation of the lighting network system developed by the manufacturer may be delivered to the customer post installation without the need to modify or exchange installed hardware.

Advantages of the UIM include its ease of configurability and reconfigurability, functional versatility, low cost and form factor. In embodiments where the UIM is configurable via the computer software package (CSP) 120 and downloaded firmware, new lighting schemes and displays may be altered simply by bringing a laptop computer within range of the UIM and wirelessly transferring data from the computer to the UIM. This obviates the need for removal, reworking, and reinstallation of a light-controlling device. Since lighting schemes can be selected through a computer interface and computer programming, the UIM enables high versatility in adapting any installed lighting elements to a desired or custom lighting display. In various aspects, the UIM provides a standardization of lighting control for various lighting elements. Since the UIM does not require custom design for each lighting installation, costs associated with custom electronic manufacture and custom installations can be eliminated reducing the overall cost of ownership of the lighting system.

In some embodiments, a small sized UIM enables the UIM to be mounted in a hidden location, and easily installed at location by a system engineer, contractor, or home user.

Figure 2B:
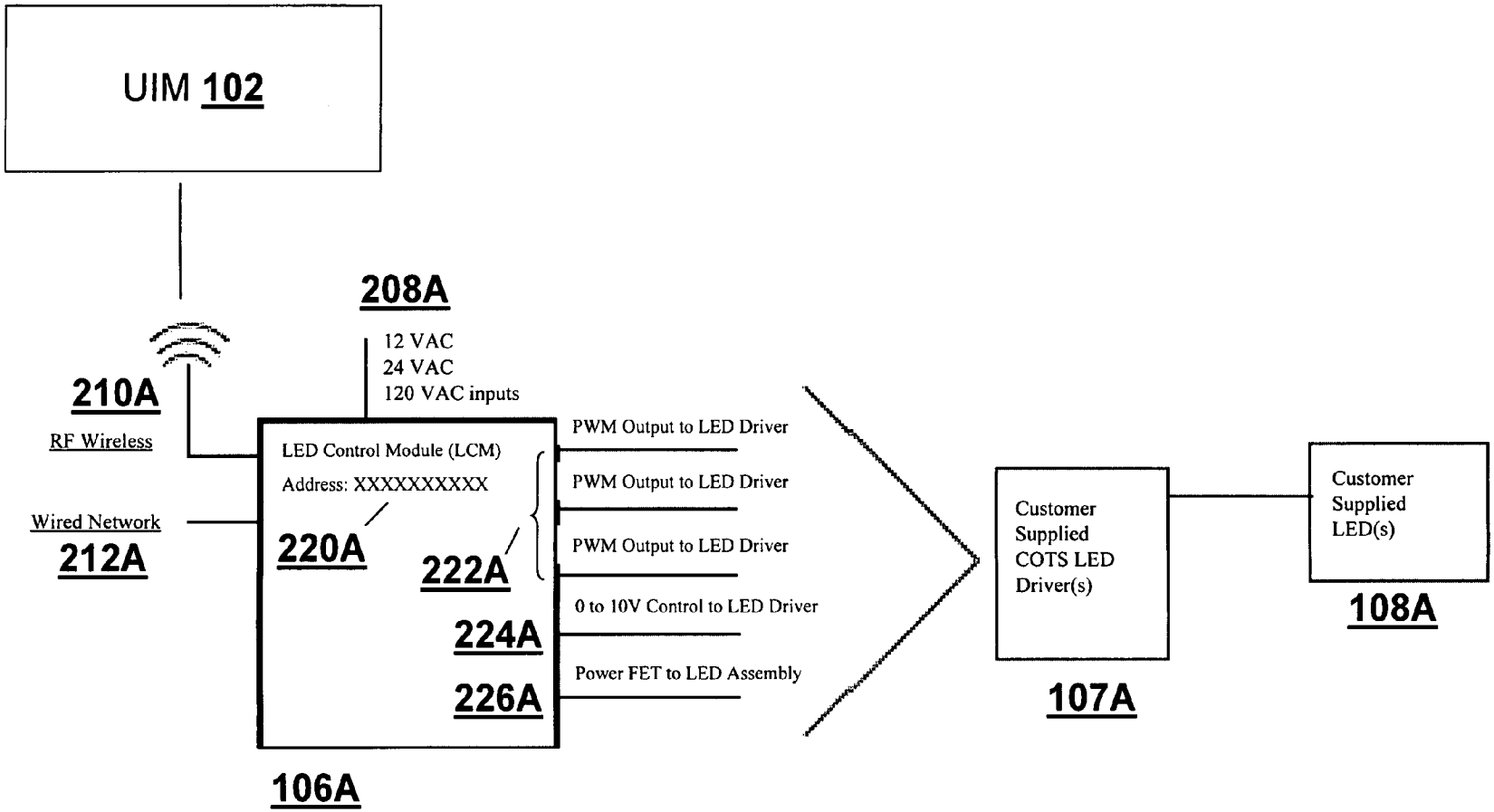
FIG. 2B is a block diagram of an embodiment of a LED Control Module (LCM)

Referring now to FIG. 2B an embodiment of the LED control module (LCM) 106A is depicted. In brief overview, the LCM may be used to control one or more LED drivers 107A, which in turn control the amount of current and/or power delivered to one or more LEDs. The LCM provides means for interfacing digital controls to LED lighting assemblies, such as simple or "dumb" LED source 108. The LCM 106 may be electrically powered through a power-supply port 208A, which provides voltage and current to enable operation of the LCM. The LCM may have a wireless RF network port 210A and a wired network port 212A, through which lighting instructions or rules may be received. The LCM may be provided with an electronically-recognizable address 220A, which may be unique to an LCM or common to a group of LCMs. The LCM may further have multiple signal output ports 222A, which for example may provide pulse width modulation (PWM) signals to one or more LED drivers. An analog output port 224A may provide a continuously variable signal, e.g. 0-10 V, useful for controlling an LED driver 107A. The LCM may also have a high current or power field-effect transistor (FET) port 226A, which may directly drive an LED assembly 108A without the use of an intervening LED driver 107A.

The LCM 106A may comprise software, hardware or any combination of hardware and software. In various embodiments, the LCM may include a central processor, such as a reduced instruction set computer (RISC), programmable logic controller (PLC), microprocessor, microcontroller (MCU), application specific integrated circuit (ASIC), digital signal processor (DSP), or a combination of these hardware components. Any one of these components, or combination thereof, may serve as a central processor or central controller for the LCM. The central processor or controller may be adapted to receive and execute computer code such as C, $C^{++}$, RISC instruction sets, Basic, Assembly, Java, or vendor proprietary machine language code. The LCM may further include peripherals such as analog-to-digital converters (ADC), digital-to-analog converters (DAC), various types of memory such as RAM, ROM, DRAM, SRAM, EPROM, EEPROM, Flash Memory, or Cache, and various types of serial communications interfaces such as inter-integrated circuit ($I^2C$) or serial peripheral interface (SPI) bus. The LCM may be assembled on a printed circuit board (PCB) using a variety of off-the-shelf IC chips, or assembled on a PCB using several custom-designed ASICs. The LCM may have a unique lighting network address 220A, so that it may be recognized and independently controlled by a UIM 102. In other embodiments, the LCM may include fixed electronic circuitry, and not adapted to receive external data input during operation.

The physical size of the LCM 106 is, in various embodiments, smaller than about 10 cm, as measured along any edge of the device. In certain embodiments, the LCM is small enough to be incorporated into an LED lighting assembly. In other embodiments, the LCM is a small handheld unit which is mounted in close proximity to one or more LED drivers 107. In additional embodiments, one or more LED drivers 107 may be incorporated into a packaged unit including one or more LCMs. For embodiments where the LCM is operable via wireless communications, an antenna may be incorporated into the LCM housing, and the housing would be substantially transparent to the wireless transmissions. As those ordinarily skilled in the art will appreciate, the form of the LCM may be designed and constructed for many environments and have a size and form factor in accordance with such environments.

Electrical power may be provided to the LCM through port 208A. Power supplied to this port may include, but not be limited to, alternating voltage and current, e.g. 12 VAC, 24 VAC, or 120 VAC, or direct voltage and current, e.g. 5 VDC, 9 VDC, 12 VDC, or 24 VDC. The power may be provided from a wall-mounted power supply, or from existing facility supplies, e.g. 120 VAC. In various embodiments, the power supply chord may be hard-wired to the LCM, or may be removably attached via a power jack to the LCM. In alternative embodiments, power may be provided by a battery, which may be mounted external to the LCM or incorporated into the LCM unit.

The LCM may be adapted to receive and transmit any type and form of digital data through a wireless RF network port 210A and a wired network port 212A. Circuit elements at these ports may include, but not be limited to, such peripherals as analog-to-digital converters (ADC), digital-to-analog converters (DAC), application specific integrated circuit (ASIC), digital signal processor (DSP), any of a variety of Ethernet port hardware, or a combination of these hardware components. The data received at the network ports 210A and 212A may be from a UIM 102, from a personal computer, or from another device configured to communicate with the LCM. Types of communications and protocols supported at these ports may include RS-232, RS-485, Ethernet 10/100, Ethernet 10/100/1000, TCP/IP, UDP/IP, IEEE 802.3, IEEE 802.11, Bluetooth, and ZigBee.

In some embodiments, each LCM 106A is assigned a device address 220A-220N, which permits independent control of multiple LCMs on a lighting network 175. The address may be programmed into the LCM during manufacture, or it may be reconfigurable and established during installation. In some embodiments, multiple LCMs may have identical addresses so that they may be controlled in concert. In yet other embodiments, the LCMs address may be dynamically configured via dynamic host configuration protocol (DHCP). For example, the LCM may receive an address 220 from the UIM, which in some embodiments, may act as the DHCP. In one embodiment, the address 220 of the LCM is an Internet Protocol (IP) address. In other embodiments, the address 220 is a Media Access Control (MAC) address. In some embodiments, the address 220 is an Ethernet Protocol address. In yet one embodiment, the scheme or encoding of the address 200, or any portion thereof, may identify the manufacturer of the LCM or any functionality of the LCM.

One or more digital output ports 222A may be included with the LCM. Digital signals supported at the output ports 222A may include CMOS, ECL and TTL signals. The output electronics for these ports may include high impedance FETs or low impedance digital line drivers. Types of signals output by the ports 222A may further include PWM signals. The PWM signal may comprise a square-wave signal having a variable duty cycle as well as a variable frequency. Increases or decreases in the duty cycle can be used to increase or decrease light output from LEDs. In various embodiments, one of the output ports 222A may drive one or more LED drivers 107A, and as many as 50. In other embodiments involving color mixing, individual ports 222A can be assigned to LEDs having distinct colors, e.g. red, amber, green, and blue.

In various embodiments, the PWM output from any of the ports 222A may also be programmed for various frequencies depending on the application. For example, a slow 100 Hz frequency, which avoids issues related to FCC EMI regulations, may be employed for general lighting applications, whereas for a machine vision application higher frequencies may be required since slow frequencies may produce undesirable aliasing effects in high speed cameras used for such applications.

The LCM may have one or more analog output ports 224A. These ports may include a current buffer or voltage follower op-amp circuit element, which provides output voltages ranging from about −24 VDC to +24 VDC. The analog output port may be used to drive one or more LED drivers, in some embodiments as many as 50 LED drivers. The analog output port may provide a voltage-reference signal, e.g. 0-10 VDC, useful for some commercial off-the-shelf LED drivers. For example, a signal level of 0 VDC output from the LCM to an LED driver may cause the LED light output to be turned off, i.e. 0%, a signal level of 10 VDC may cause the LED light output to be turned fully on, i.e. 100%, and any value between 0 VDC and 10 VDC may cause a corresponding linear adjustment of the LED light output.

A power FET port 226A may be included in the LCM 106A. A circuit element for this port may include a power MOSFET, which can supply output current levels in excess of 100 amps. The power FET port may be used to directly drive one or more LED assemblies 108A, bypassing the LED driver 107A. In some embodiments, the port 226A may simply be used to turn one or more LEDs on and off. In other embodiments, the signal at port 226A may be modulated rapidly, greater than about 60 Hz, providing a pulse width modulation signal capable of dimming the light output from one or more LED assemblies.

In operation, the LCM provides a means for interfacing digital, or digital and analog controls to common, passive or "dumb" LED fixtures. The LCM 106A may receive lighting instructions or rules from one or more UTMs 102 located near the LCM or connected to the LCM via the wired network port 212A. The LCM processes the instructions and outputs control signals through some or all of its output ports 222A, 224A and 226A to operate one or more LED drivers 107A and LED lighting assemblies 108A. In some embodiments, the LCM may be incorporated into one LED lighting assembly 108A, the assembly designated as a "smart" LED assembly, and one or more "dumb" LED assemblies may be operatively connected so that their action mimics the action of the "smart" assembly. In some embodiments, the control signals are produced by the LCM's internal processor according to a set of instructions or rules transmitted to the LCM by the UIM 102. For example, the instructions may be to continuously vary duty cycles synchronously on three square wave signals applied to each of three ports 222A, where each of these signals is operatively applied to LED assemblies, through the LED driver 107A such that one port 222A activates a red LED assembly, one a green LED assembly and one a blue LED assembly. The square-wave signals may be TTL type signals, having a voltage swing from about 0 VDC to about 5 VDC, in some embodiments. The net result of such an instruction set would be to maintain a constant illumination color while continuously varying illumination intensity. In another embodiment, the instructions may be to continuously vary duty cycles asynchronously on three square wave signals applied to each of three ports 222A. The net result of such an instruction set may be to continuously vary both illumination color and intensity. In yet other embodiments, instructions or rules may be created in real time at the UIM 102 in response to pre-selected events or conditions, and transmitted to the LCMs over the lighting network so that real-time event tracking can be reflected in light-output from the LED assemblies. For example, the UIM may track temperature, wind speed, or ambient noise level through its analog input ports 204, process the data internally in real time, and continuously transmit new instruction sets to the LCM as these environmental parameters change.

In operation, the FET output port 226A may be used in some embodiments to enable and disable power applied to one or more LED drivers, or one or more LED lighting assemblies. This use of the FET port may override all other lighting commands to enable or disable lighting. Similarly in operation, the analog output port 224A may be used to provide graduated scaling of light output intensity from the LEDs. For example, a 1 VDC output from port 224A may cause a reduction in light output to 10% of maximum output for all LEDs controlled by the LCM 106A, whereas a 9 VDC output from port 224A may cause an increase in LED lighting intensity to 90% of maximum output. In operation, controlling signals output from ports 222A, 224A, and 226A may be applied to one or more LED drivers simultaneously or sequentially to obtain a desired lighting display.

Although the LCM 106A in FIG. 2B is shown with a number of input and output ports, the LCM may be constructed, configured or designed with any number of the same and/or different input and/or output ports. For example, the LCM could include only one wireless network port 210A, no wired network port, and one wireless network output port (not shown), wherein the wireless network output port communicates to wireless networked LED drivers. In other embodiments, the LCM may include one or more digital input ports (not shown) and one or more analog input ports (not shown), which would provide a means for feeding back signals from one or more LED drivers or LED lighting assemblies. For example, thermal sensing, e.g. via a thermistor, LED intensity sensing, e.g. via a photodiode, and color sensing, e.g. via multiple photodiodes, elements located in an LED lighting assembly may be configured to provide temperature and light output information back to the LCM, so that overheating conditions and lighting failure conditions can be detected and acted upon. Corrective actions may include disabling or reducing current delivered to one or more LEDs, adjusting the LEDs' color mixing ratio, or transmitting an error notification back to the UIM in the event of complete LED failure. The LCM 106A may further include status indication elements, such as LED status lights, and a liquid crystal display (LCD). These elements may provide convenient visual information to maintenance personnel, and indicate successful operation of the LCM and attached LED circuitry or indicate types of errors within the local lighting network.

Although FIG. 2B depicts a lighting network having a separate UIM 102 which communicates with one or more LCMs 106, in another embodiment all the functionality of the UIM may be incorporated into one or more LCMs. In such embodiments, a separate UIM may be unnecessary. For example referring to FIG. 1A and FIG. 2A, all the functionality of UIM 102 may be incorporated into LCM 106B, and UIM 102 eliminated from the network. In this embodiment, the lighting group B may be designated as a parent group, and the other groups A, C-N designated as children of the parent. Instructions or rules established externally to the lighting network, e.g. via the CSP 120, may be downloaded to the parent group's LCM 106B and then distributed over the network 104 to offspring lighting groups. In some versions of this embodiment, the CSP 120 is operable on a laptop computer equipped with a wireless Ethernet port. All or any of the lighting groups may be reprogrammed by executing the CSP, selecting new lighting rules, bringing the laptop within range of the parent LCM 106B, and downloading the new instructions.

In yet another embodiment, each of the LCMs 106A-106B may include all the functionality of a UIM, or any portion thereof, and the control of lighting may be distributed over the network 104. For example, LCM 106A may sense humidity, 106B may sense wind speed, and 106N may sense temperature. The information gathered by each LCM may be shared across the network 104, and affect operation of each LCM. In this embodiment, new rules or instructions established externally may be downloaded to any one of the LCMs, and the receiving LCM would then distribute the new rules across the network.

Advantages of the LCM include its ease of configurability and reconfigurability, functional versatility, low cost and form factor. In embodiments where the LCM is configurable via the computer software package (CSP) 120 and downloaded firmware, new lighting schemes and displays can be altered simply by bringing a laptop computer within range of the UIM and wirelessly transferring data from the computer to one or more UTMs existing within the lighting network. Data is then transferred from the one or more UTMs to each LCM within the network. This obviates the need for removal, reworking, and reinstallation of any light-controlling device. Since lighting schemes can be selected through a computer interface and computer programming, the LCM enables high versatility in adapting any installed lighting elements to a desired or custom lighting display. In various aspects, the LCM provides a standardization of lighting control for various lighting elements. Since the LCM does not required custom design for each lighting installation, costs associated with custom electronic manufacture and custom installations can be eliminated reducing the overall cost of ownership of the lighting system. In some embodiments, the potentially small size of the LCM enables it to be mounted in a hidden location, and easily installed at location by a system engineer, contractor, or home user. In some embodiments the LCM may be incorporated into an LED lighting assembly by the manufacturer, eliminating the need for any additional installation tasks and time related to the LCM.

C. Configuration Software Package (CSP)

Figure 3A:
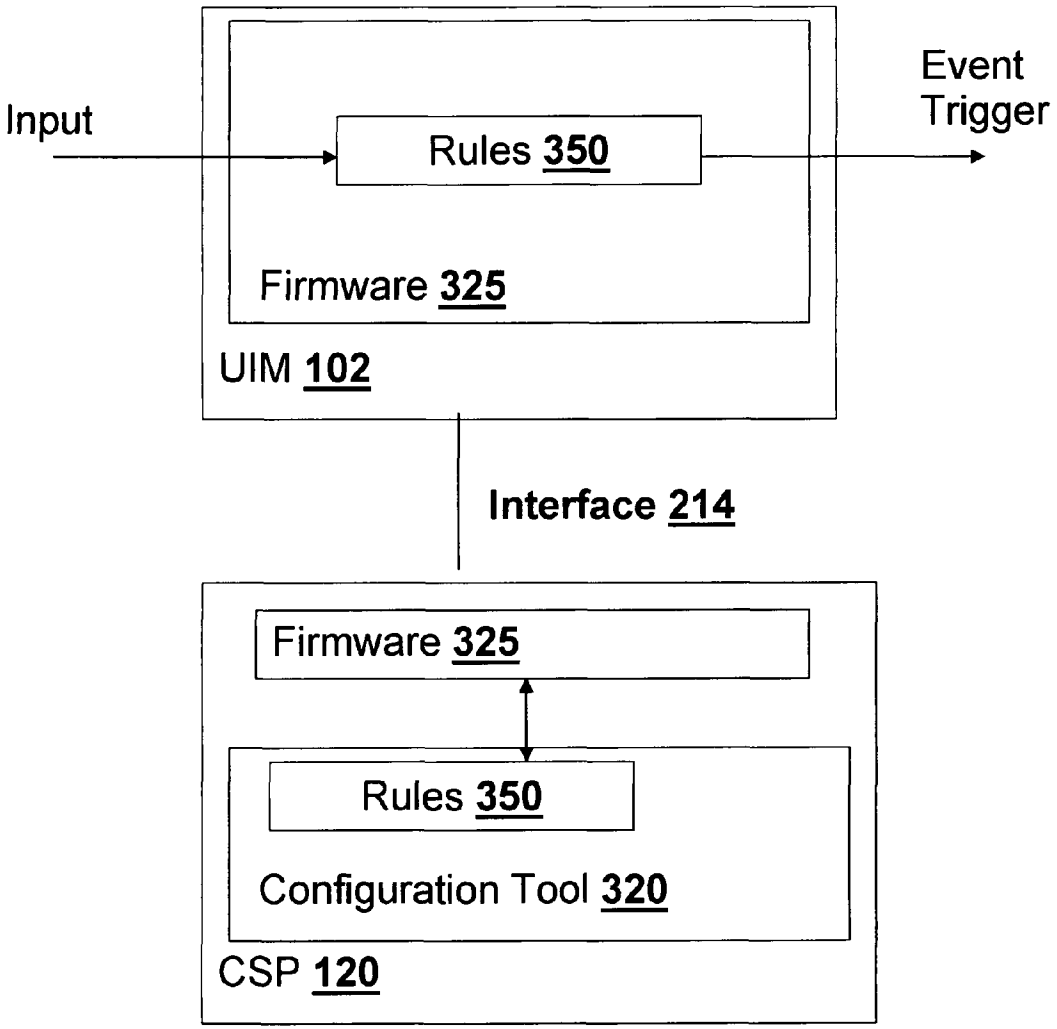
FIG. 3A is a block diagram of an embodiment of a configuration software package (CSP) for providing software, logic and rules for configuring the UIM.

Referring now to FIG. 3A, an embodiment of the configuration software package 120 is depicted. As Lighting OEMs are typically not electronic designers nor are they software designers, the CSP 120 provides a configuration mechanism and means for easily configuring advanced lighting control management and features into the lighting network 175. In brief overview, the CSP may include a computing device or PC (personal computer) based configuration tool 320 that may be used to simply program the system with one or more rules 350 such that dependent on the desired level of effect or control, a lighting OEM may program the lighting network system without any prior knowledge of programming or without the need of an expensive integrated control system. The configuration tool 320 may include a graphical user interface for configuring rules 350 to be deployed or exported as firmware 325 in the UIM 102 for controlling or managing the lighting network 175.

In one embodiment, the configuration tool 320 includes any type and form of graphical modeling tool for creating, modifying, editing or otherwise configuring a representation of a lighting network 174. In some embodiments, the configuration tool 320 includes any type and form of block modeling tool. In other embodiments, the configuration tool 320 includes a user interface and system for creating, generating or otherwise configuring elements on a screen and linking or forming relationships between elements, such as found in a network diagram or system architecture diagram.

The configuration tool 320 of the CSP includes any type and form of user interface. In one embodiment, the configuration tool 320 comprises any type and form of command line interface. In various embodiments, the configuration tool 320 comprises any type and form of graphical user interfaces. The graphical user interfaces may include any arrangement and combination of graphical user interface elements, including menus, drop down lists, choose lists, trees, drag and drop elements, etc. In some embodiments, the configuration tool 320 includes any type and form of setup, configuration or installation wizards to guide a user step by step through a setup, configuration or installation of a lighting network 175 or any component thereof, such as a UIM 102.

In some embodiments, the CSP 120 is used to configure a UIM or the lighting network and not to operate a UIM or a portion of the lighting network. Therefore, in these embodiments, once the CSP configures each UIM on the network, the CSP may no longer be required and the UIM and linked LCMs will function together as predefined by the CSP. In other embodiments, the CSP 120 may used during operation of the UIM or lighting network to dynamically change the configuration or logic of the UIM on the fly or on an as needed or ad-hoc basis. In one embodiment, the CSP 120 may be used as a testing tool for any UIM or any portion of the lighting network to test the functionality, logic or operations to what may be expected.

The configuration tool 320 of the CSP may include any of the following features such as: 1) drag and drop components (UIM, LCM) and component functionality, 2) drag and drop pre created programs, 3) drag and drop analog and digital inputs, 4) create rules 350 with no complex programming, and 5) create relationships, no complex programming. Using drag and drop components and pre-defined and configurable component functionality, a user, such as an OEM customer, may fully define the lighting system using setup guides that walk the user through the set up process. Through Drag and Drop icons, the user selects a defined quantity of LCMs and configures each address for functionality. Via the configuration tool 320, these user may review detailed features of a specific LCM while also being able to review the overall system allowing the creation of relationships between these drag and drop components, such as relationships between the LCMs and UIMs. In some cases, in order to link a drag and drop a component for configuring an LCM or UIM, an address, such as a unique address, of the LCM or UIM must be associated with the drag and drop component.

In some embodiments, the configuration tool 320 provides a user interface for configuring one or more rules 350 for a UIM in controlling or managing the lighting network 175. A rule 350 may include any type and form of logic for specifying, defining or otherwise configuring the behavior, action, command or instructions to be performed by the UIM and/or LCM, or any other portion of a lighting network 175, in response to any type and form of input. In some embodiments, a rule 350 triggers, generates or otherwise provides an event based on an input. The input may include any type of analog or digital information or data received via any port of the UIM and/or LCM. For example, the input may include data from one or more sensors interfaced to the UIM. The output or event may include any type and form of directives, commands or instructions to the LCM and/or LED driver. For example, the output may include instructions to change the lighting affect in any manner, such as triggering a sequence of changes to the color of lights in any sequence or combination. In some embodiments, the rules 350 may cause the lighting control and affects thereof to have a relationship with or correspond to input from the external environment. For example, the weather and/or time of day input, or any changes thereof, to the UIM may case a rule 350 to trigger a change in the lighting via the LCM in a configured or desired manner.

The configuration tool 320 may comprise any type and form of business rules, logic, operations or functionality to provide any form of executable instructions 325 to be created, generated or otherwise provided for use by a UIM 102. In some embodiments, the set of executable instructions used by the UIM may be referred to as firmware 325. The executable instructions or firmware 325 may include any type and form of source code, object code, libraries, APIs, header files, data files and configuration files in accordance with the operation of the UIM. These programmed executable instructions may be stored in any type and form of memory of the UIM, such as read-only memory, permanent or semi-permanent memory.

The configuration tool 320 may include a code generation engine for generating code or firmware 325 for the UIM based on the configuration specified by a user via the user interface. The configuration tool 320 may generate the code representing the configuration using any type and form of instruction set, such as C, C++, RISC instruction sets, Basic, assembly language, programming language for microcontrollers, Java, or any vendor proprietary machine language code. The code generation engine may generate source code and then compile the source code into executable form. The configuration tool 320 may include any type and form of download or export functionality to install or otherwise provide the firmware 325 to the UIM such as via interface 214.

By way of example, some of the features of the configurability of the CSP 120 are discussed below. It should be noted that in order to further ease configuration, most of the features as noted below may be asked in a systematic order via a "wizard" setup guide or would be available via drop down menus. Examples of a wizard setup guide will follow in discussions of FIGS. 3B-3N.

When configuring a specific LCM 106, the user interface of the configuration tool 320 may include user interface elements providing configurable to 1) enable or disable each output of the LCM, 2) select or specify a frequency of enabled PWM output, and 3) select or specify a voltage range of enabled analog output. The configuration tool 320 may include drag and drop icons to represent LED Drivers connected to or to be connected to the LCM under configuration. In some embodiments, the configuration tool 320 provides drag and drop icons to represent LEDs 108 connected to or to be connected to the LED drivers. Although generally discussed herein as drag and drop icons any type and form of graphical user interface elements may be used to represent LCMs, LED drivers and LEDs using the configuration tool.

Via the user interface of the configuration tool 320, a user may view the following types of data and relationships in connection with an LCM 106: 1) which UIM module is this particular LCM linked to, 2) which LCM modules are similar in configuration, 3) which LCM modules are connected to the same UIM modules. In some embodiments, the user may view the address 220 of an LCM via the configuration tool and change or modify this address. The configuration tool 320 may allow the user to assemble LEDs and LED drivers such that the overall function as configured may be simulated prior to exporting code to the UIM. When configuring a specific UIM, the user interface of the configuration tool 320 may provide user interface elements for the assignment of LCMs to the specific UIM. In some embodiments, this assignment of LCMs to UIMs may be done graphically via a linking element. In other embodiments, the assignment of LCMs to UIMs may be performed by the user via selection from a choose list or drop down list of via text or other entry. The configuration tool 320 may provide a user interface to define any of the inputs of the UIMs. In some embodiments, the inputs may be available as drag and drop icons, for example, if a temperature sensor is selected, simply drag in a temperature sensor and connect. The configuration tool 320 may provide a user interface to define the function of an LCM once the UIM receives an input, such as via one or more rules 350. The configuration tool 320 allows a user to view, configure or change the address of this particular UIM and also see when the address may have been last updated.

In some embodiments, once the function, operating, and relationship parameters are defined for the UIM in advance via the CSP 120, the UIM will function or act as an embedded system with the purpose of operating as defined. In addition and in one embodiment, any LCM assigned to the UIM will be notified via the LCM's address of its purpose and commands. For example, upon power up of the UIM and applicable LCMs, the UIM may notify all LCMs that are assigned thereto of the LCM's respective configuration. If the LCM loose power, the LCMs may hold the previous state until connection is reestablished. If the LCM fails to connect to a UIM, the UIM may indicate an error code and continue to operate normally less the missing component.

Once the overall system definition has been completed, the possible lighting effects are endless. A user may create any combination of configurations for UIMs and LCMs for a lighting network 175 with any type and form of rules 350 that may be supported by the system. The rules 350 provides any desired lighting effects based on inputs available to the UIM and output control provided by the LCM and LED drivers. While the interface is a relative simple GUI, some users may prefer templates or pre-created configuration for getting started. In some embodiments, the configuration tool 320 provides drag and drop pre-created, pre-defined or otherwise predetermined programs or configurations. A user may drag and drop via the configuration tool a program similar to that of which is trying to be accomplished. In addition to drag and drop, the CSP 120 will attempt to apply the sequence to the Lighting Network as defined, prompting the user for input and by analyzing the devices present. For example, a user may select a pre-created program for "Chasing Lights". At that point, the CSP may prompt the user via a survey to select options regarding the overall effect, thus at the completion of the customer survey, the Chasing Lights program also having recognized the quantity of LCMs will have created any desired or suitable program per the user requirements. The program may be further modified such as via tweaking of time values, intensity values, etc. . . .

As the UIM includes capability for various inputs, whether sensor, switch, or data, the configuration tool 320 may be designed or constructed such that inputs may be dragged and dropped into the graphical user interface and assigned to the applicable UIM. Through this assignment, the user may be informed of features available such as data that may be referenced and used accordingly in the associated programs. For example, with an "Internet" digital input, the user may have accessible: weather data, stock information, sun rise times, sun set times, sports scores, etc. Any of the Internet data may be queried or obtained via any network or Internet connected computing device, such as a server available to the UIM. The configuration tool 320 may provide the user with the option to select which of this data is relevant to the program or desired to use with the rules 350.

For example, the UIM 102 may have access via the Internet port any data and information on the local weather, including temperature data, such as the local high temperature for the day and the local low temperature for the day. In this case, the user may select the local high and local low temperatures for the day as data input such that this data may be available in a field for configuration. The user may then create rules 250 or a program 325 such that this data is used as a variable for creating a lighting effect via the UIM and the lighting network. In some embodiments, each UIM may have a defined number of potential inputs and that multiple inputs may be incorporated into the configuration of the UIM. For example, when a switch connected to a UIM is engaged, weather data may available as input to a rule 350. When a switch is disengaged, the UIM may run a pre-defined program.

In addition to defining the configuration of the UIM and LCM within a lighting network, the configuration tool 320 of the CSP provides a user interface for a user to create rules and relationships. For example, a rule 250 may be configuration of an "IF" statement whiles relationships being may be for example how an LCM at a first address interacts with the UIM of a second address. Rules may be configured via "wizard" configuration or may be configured via scripting depending on the experience of the user. In some embodiments, a rule 350 creates a definition or otherwise established a relationship that links the input on the UIM to the output of one or more LCMs. For example, a rule may created that specified if the local high temperature for the day exceeds 70 F, then set LCM at the first address to "pink light". This pink light for example may have been defined earlier by the user via the configuration tool 320 as the combination of 50% intensity of PWM output 1 and 75% intensity of PWM output 2, which in turn mixes blue and red to create pink.

Other rules may be created based on the variable input data available to the UIM. In addition, rules may be created that are triggered by the input data into the UIM and perform a plurality of actions. For example, a rule 350 may specify if the local high temperature for the day exceeds 70 F, then set LCM at a first address to "pink light", set LCM at a second address to "blue light", and LCM at a third address to "yellow light"; hold this state for 2 seconds, then run a lighting effects program identified as Chase 3. For example, Chase 3 rule or program may have been defined through the wizard as a program that would start LCM 1 at TBD color, then chance the color of LCM 1 to the color of LCM 3, the color of LCM 3 to LCM 2, the color of LCM 2 to LCM 1 and cycle over a period of 1 second.

The advantages of the CSP 120 and configuration tool 320 is the ability for pre-set or predetermined designs and intelligent setup guides/wizards to guide the user through the configuration process as well as making intelligent decisions as to what components of the setup may be automated and what components should be asked of the user. In some embodiments, the configuration tool 320 or CSP 120 may have an advanced scripting mode which works well for more technology savvy users, such that via a programming language, script or command line commands configure any portion of the lighting network 175 as desired.

Through the use of intelligent configuration menus, the configuration tool 320 of the CSP 120 asks the user questions regarding the system configuration that lead to additional questions based on the user's responses. This type of menu configuration is demonstrated by example via the corresponding embodiments depicts in FIGS. 3B-3N. Upon defining the system via the configuration menus, the system as configured may be visually displayed on screen. The CSP 120 may include any type and form of simulator or simulation tool for the user to simulate the system as well as change variables based on preference. In addition to the individual settings of each LCM and UIM, the CSP may also display relationships and the rules that govern them.

Figure 3B:
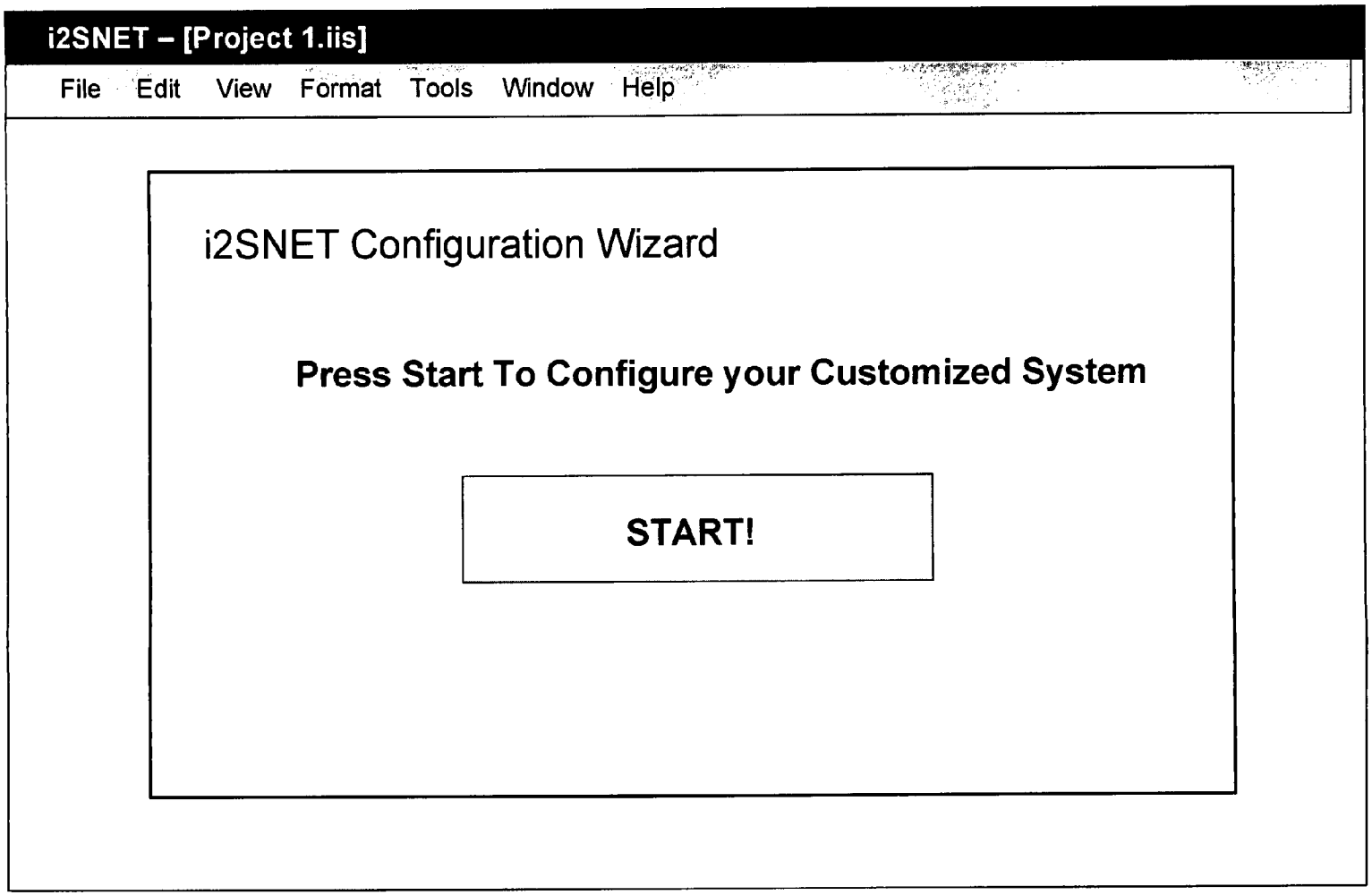
Figure 3C:
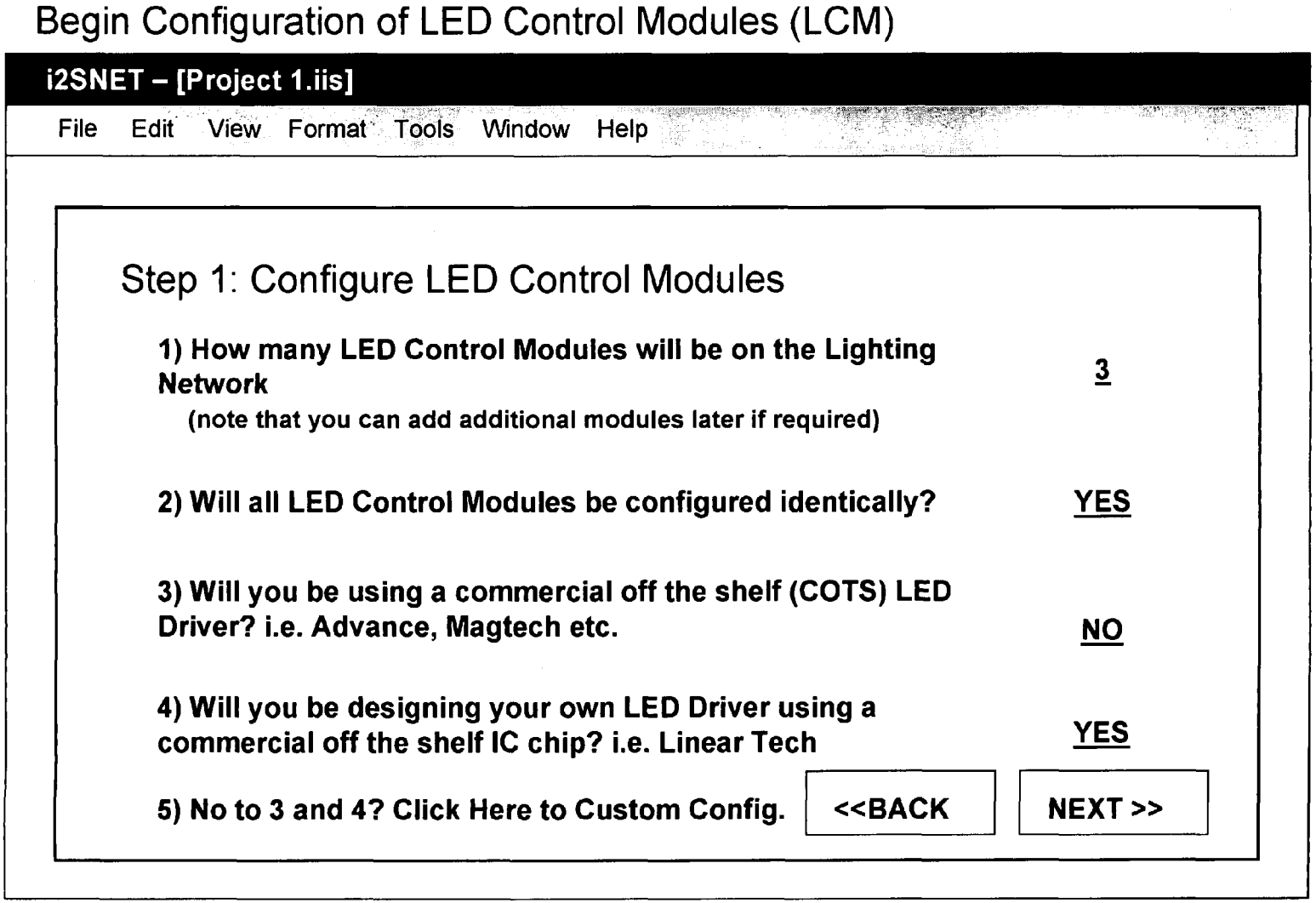

Referring now to FIGS. 3B-3N, example embodiments of user interface of the configuration tool 320 of the CSP 120 are depicted. FIG. 3B depicts an embodiment of a start screen of a configuration wizard for the CSP 120. The user may select a menu item to start the wizard and then select a start button to continue the wizard process. FIG. 3C depicts an embodiment of a user interface of a step in configuring an LED control module. As show in the example wizard screen, the user may specify the number of LCMs in the lighting network, and whether or not the LCMs will be configured in the same manner. Furthermore, the user may specify if an off the shelf LED driver will be used for controlling the LED source or if a customer LED driver will be used. The user may navigate back to the previous screen using the back button or continue with the wizard process via the next button.

Figure 3D:
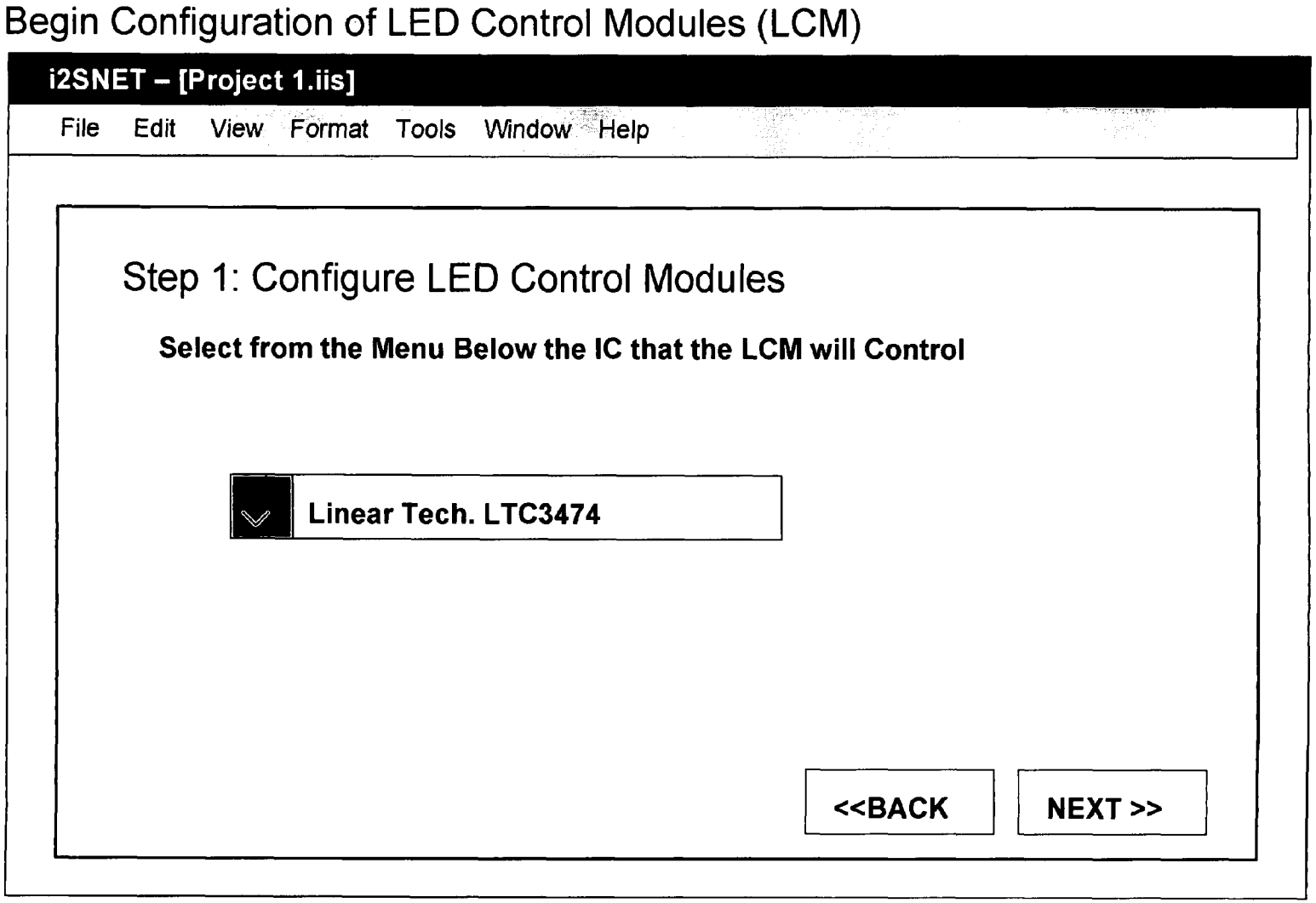
Figure 3E:
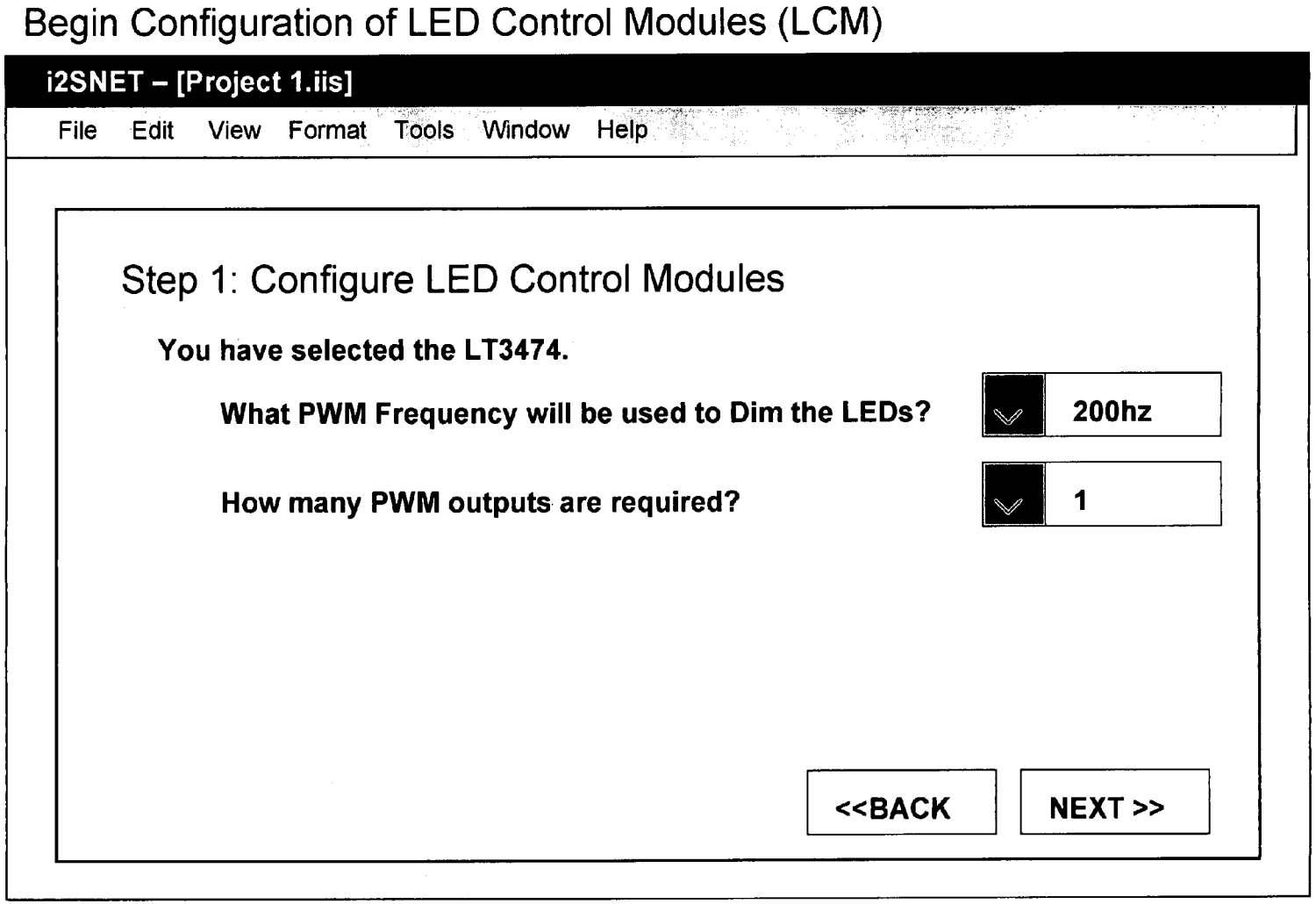

FIG. 3D depicts the next user interface in the wizard process for configuring the LCM. In this screen, the user select may select the type, name or identifier of an Integrated Circuit or LED driver 107 the LCM may control. The user may select the next button to continue the configuration of the LCM as depicted in FIG. 3E. In this user interface, the user may configure the number of PWM outputs for the selected IC in FIG. 3D and the PWM frequency used for dimming the LED. At the next step in the configuration process as depicted in FIG. 3F, the user may configure the address for each of the LCM modules. In some embodiments, the user may be able to create, generate or provide an address naming scheme or batch label for the LCMs.

Figure 3G:
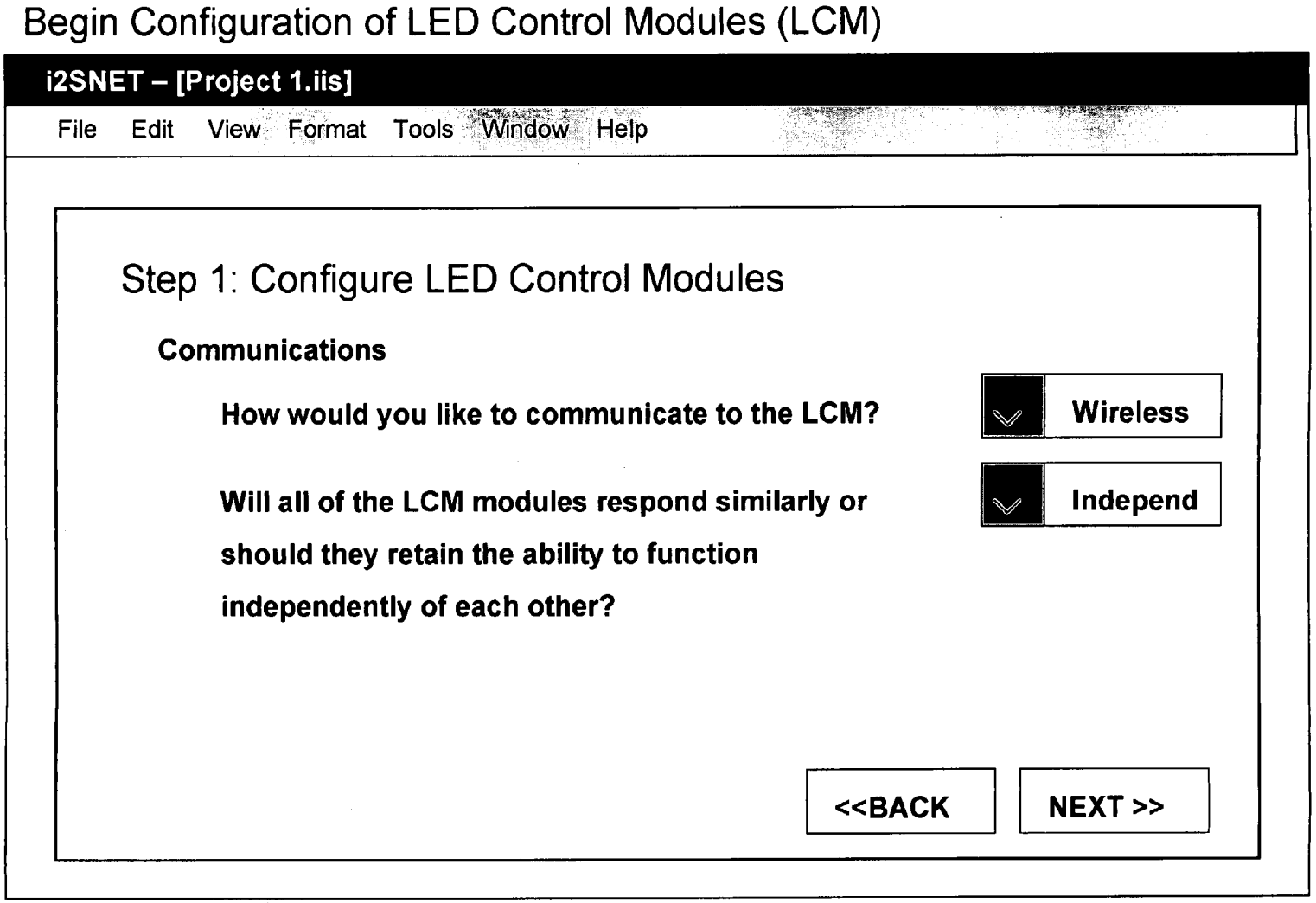

Next, at FIG. 3G, in this example configuration wizard, the user may configure the communications portions of the LCM to select the type of network communications and to specify whether or not the LCMs response similarly or functional independently of each other. The user may select that the LCM communicates with the UIM via a wireless network or via RF. In some embodiments, the user may select that the LCM communicates with the UIM via a wired network. In some cases, the user selects the LCMs to function dependently to each other. In other cases, the user selects the LCMs to function independently such that each may receive lighting commands and respond to such commands independently from another LCM.

At a next step in the wizard configuration process of the configuration tool 320, the user may configure the UIM 102. In the example embodiment of the user interface depicted in FIG. 3H, the user may identify, configure of select the number of UIMs to be deployed or used in the lighting network 175. The user may identify whether or not the UIM will be connected to online via an Internet port, and how many interfaces may be connected to a single UIM. The user may select the Next to continue the process, such as by configuring or specifying the address of the UIM via the user interface depicted in FIG. 3I. In this user interface, if the user identified a plurality of UIMs for the lighting network 175, the user may specify addresses for each of the plurality of the UIMs via this screen. In other embodiments, the user may select the Back button at any of the screens such as those depicted in FIGS. 3H and 3I to change previously configured elements.

Figure 3H:
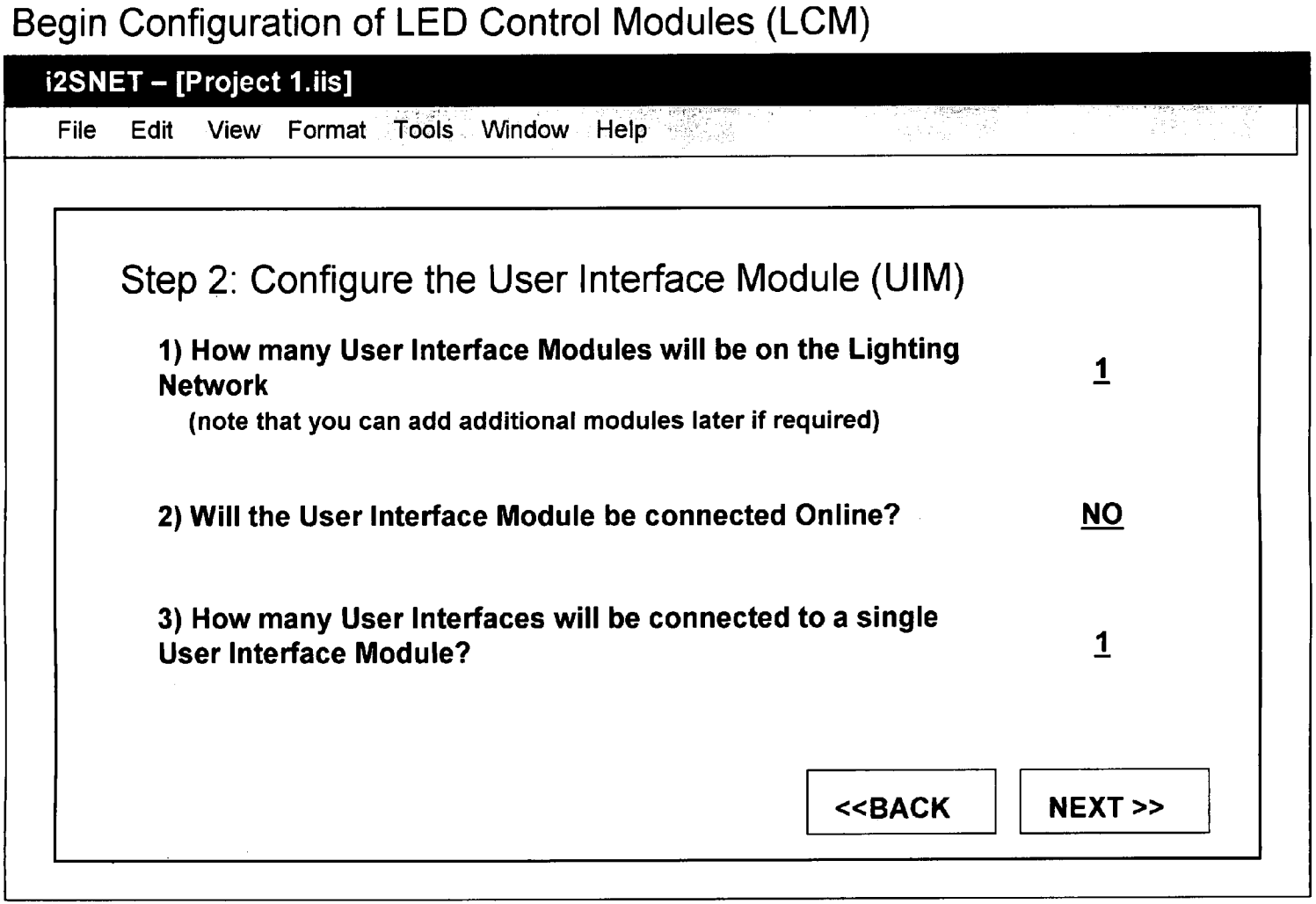
Figure 3I:
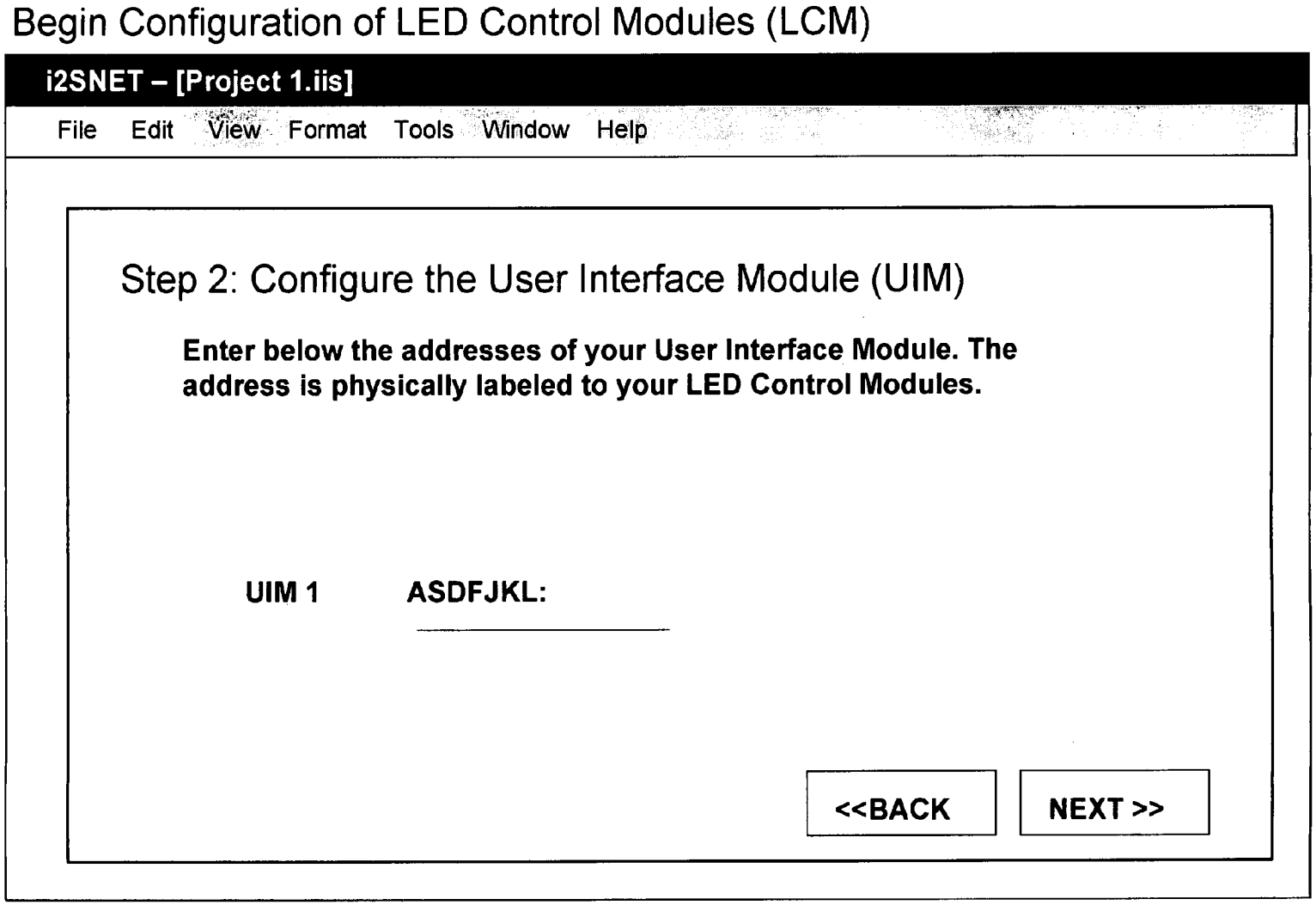
Figure 3J:
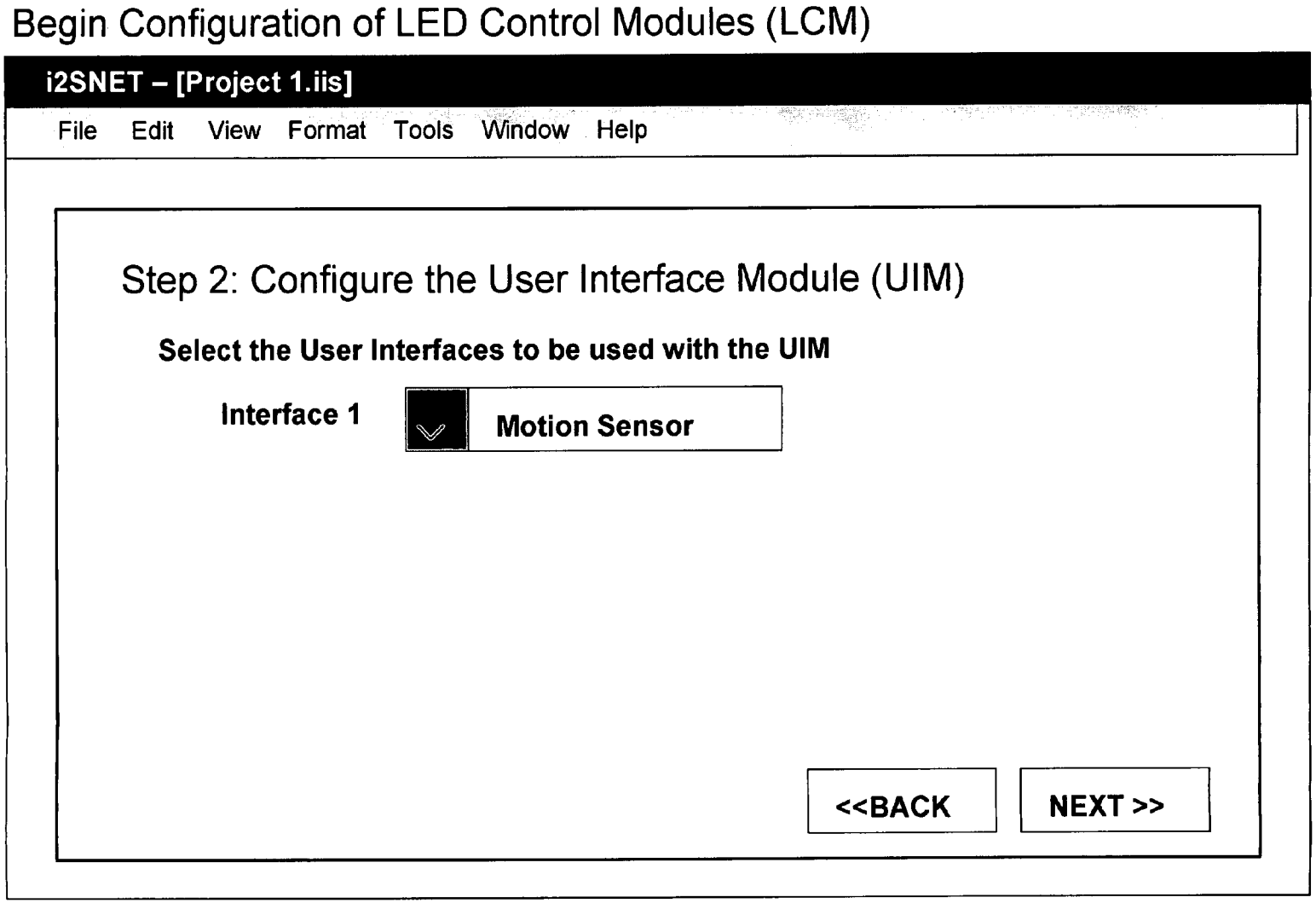

Based on the number of user interfaces specified in the screen of FIG. 3H for the UIM, the user may specify the type of interface for the UIM. In the embodiment depicted in FIG. 3J, the user may select any type of interface available from a drop down or choose list, such as selecting a motion sensor as shown in FIG. 3J. If the user selected multiple interfaces for the UIM in FIG. 3H, the user may select or specify the UIM for each of the interfaces via the user interface of FIG. 3J. The user may configure or specify the type of data and information available to the UIM by specifying and configuring analog, digital or Internet inputs to the UIM.

Referring now to FIG. 3K, an embodiment of a step in the configuration process to create a rule 350 for the UIM is specified. In this example, screen, the user configures a rule 350 based on the type of sensor defined for an interface in a previous screen. In this case, the user specifies a rule 350 based on a motion sensor sensing motion and in response to this input, delivering a fade light output up program to the LED source 108 via the LED driver to 100% over 2 seconds and maintain 100% light output for 2 minutes. At the end of 2 minutes, the fade light output down program is run to 0% until again receiving sensing motion input. The user may select which of the identified LCM modules for which to apply this rule. For example, the user may select the LCMs by the configured address. FIG. 3L depicts an embodiment of a screen for specifying another rule 350 for the lighting network 175. In this embodiment, the use specifies a rule 350 based on the motion sensor interface of interface 1 sensing motion. In response to the input of a sensing motion detection by the interface, the rule states to produce or trigger a strobe light output configuration for 10 minutes between 3% output and 100% output for each strobe lasting 0.1 seconds. The user may apply this second rule to any one or more of the LCMs 106.

Although FIGS. 3K and 3L show specific examples for a motion sensor embodiment of a UIM interface, those ordinarily skilled in the art will appreciate the user may specify a rule 350 based on the type of interface and the data or information available from the interface. Furthermore, the user may specify any type and form of lighting effect to occur or trigger in response to input or events from the interface. Additionally, the user may specify a type of light color, the intensity of light output, and any temporal information for the length of the lighting effect.

Figure 3M:
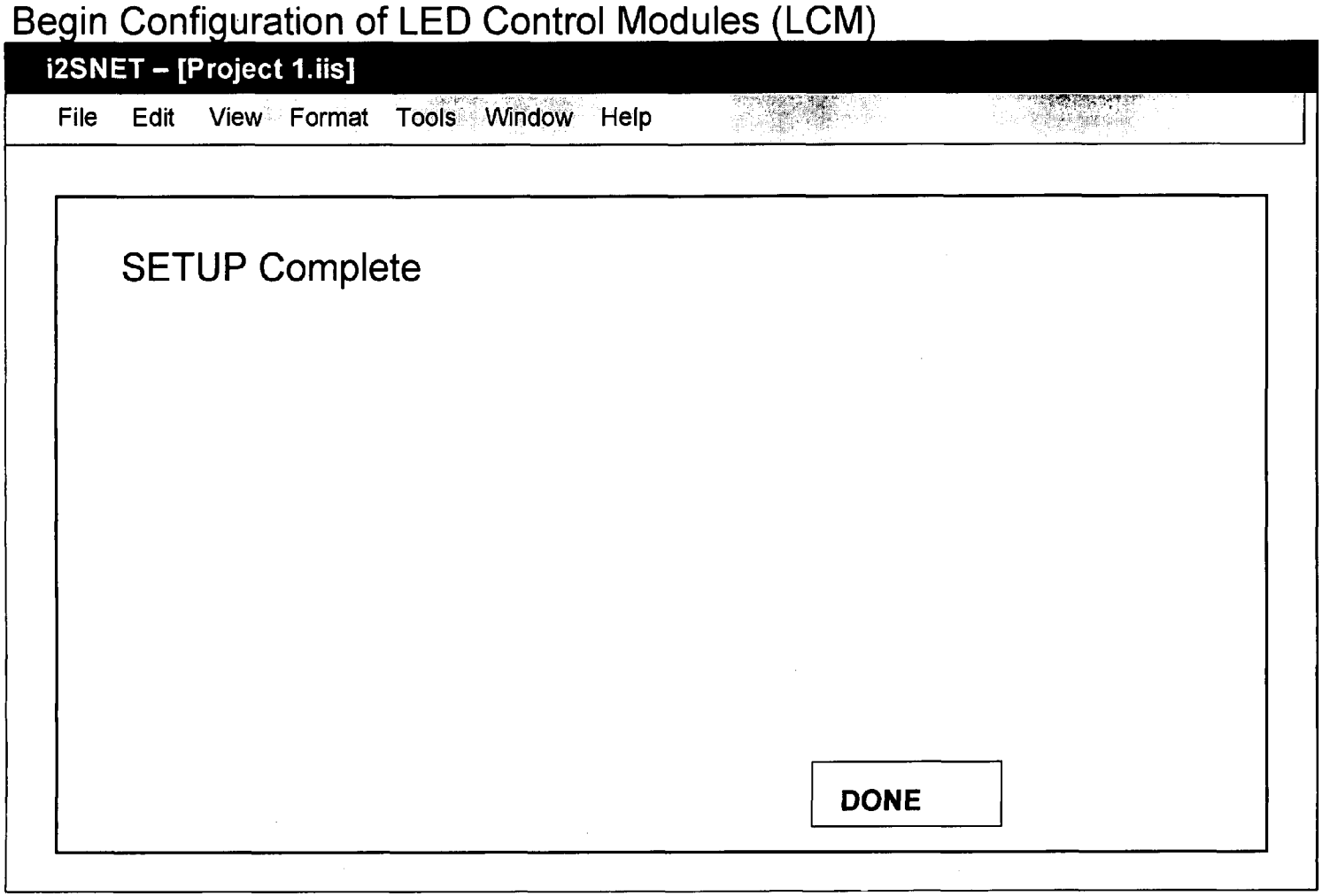

Referring now to FIG. 3M, an embodiment of a user interface of the configuration tool 320 for identifying completion of the setup wizard process is depicted. The user may select the Done button to complete the process. In other embodiments, the user may select a Back button to review and/or change any previous configuration or selections.

Figure 3N:
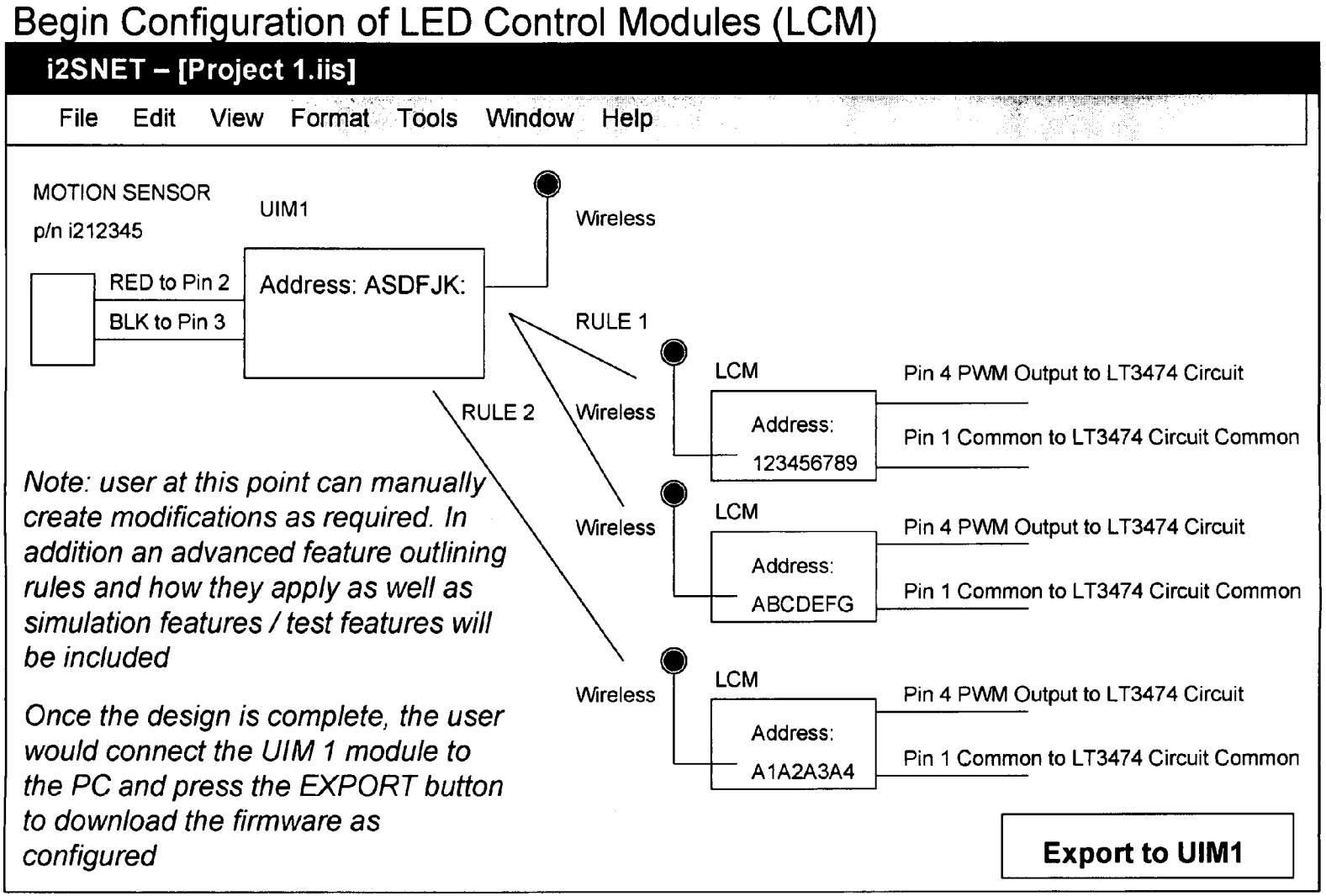

FIG. 3N depicts another embodiment of a user interface of the configuration tool 320 depicting a configuration and layout of the lighting network 175. In one embodiment of this screen, the configuration tool 320 provides a visual depiction of the configuration of the lighting network 175 in accordance with the user's definitions and configuration selections. The user may be able to modify the configuration further via the configuration tool 320, such as manually changing a configuration element. In some embodiments, the user may be able to simulate the configuration via execution of a simulation or testing tool available via the user interface of the configuration tool 320.

Once the user is satisfied with the configuration, the user may select an export button of the configuration tool 320 to download, upload, export or otherwise transmit the corresponding firmware 325 or configuration updates to the UIM 320. In some embodiments, the selection of the export button triggers a code generation process for the CSP 120 to generate executable instructions or firmware 325 corresponding to the completed configuration for the UIM. Upon completion of the generated code, the CSP may download or provide the code to the UIM via interface 214.

Figure 4:
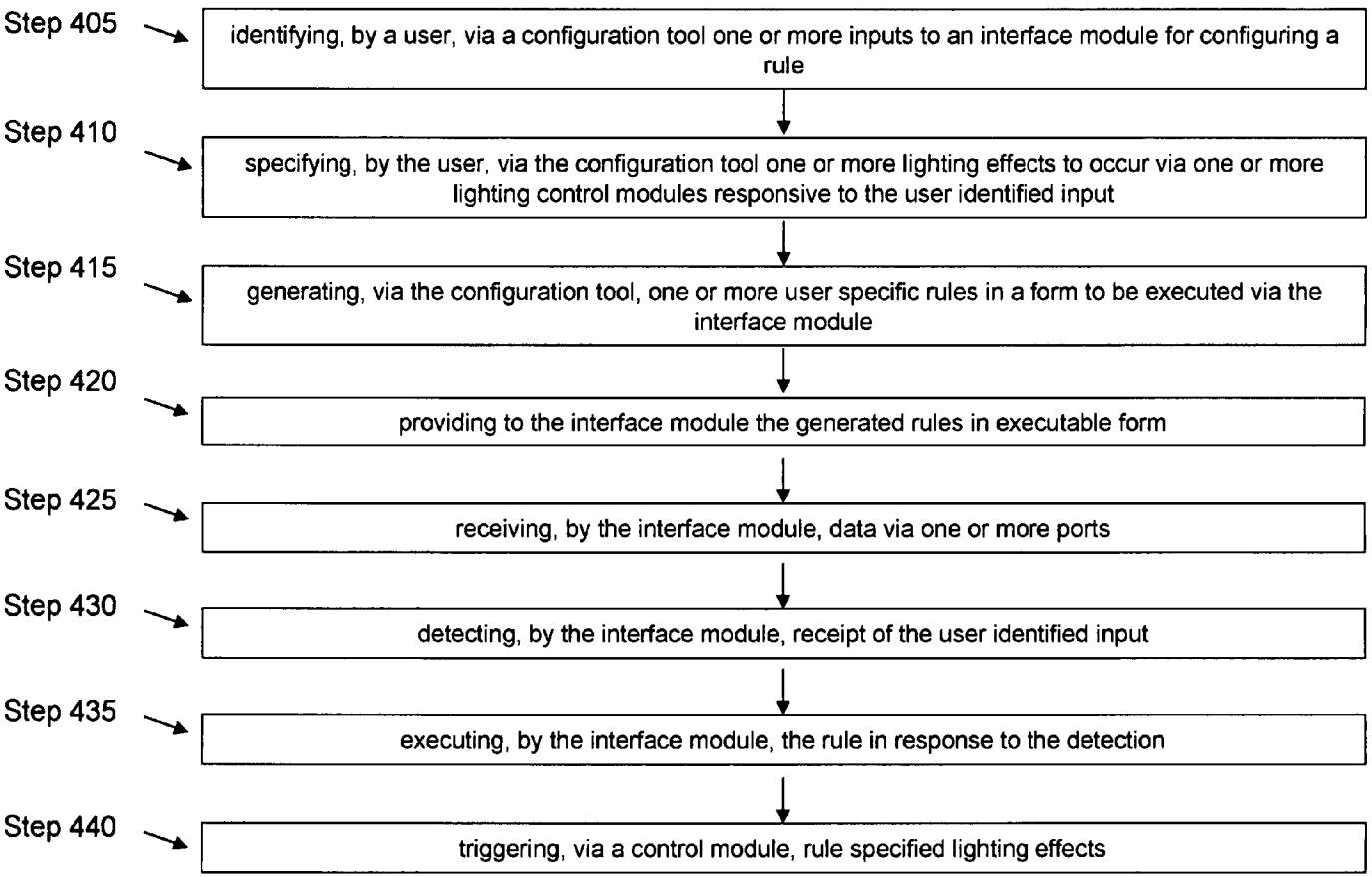
FIG. 4 is a flow diagram of an embodiment of a method for configuring and executing a user specified rule to control lighting effects.

D. Methods for Configuring and Executing User Specified Rules to Control Lighting Referring now to FIG. 4, a flow diagram of an embodiment of steps of a method for configuring and executing user specified rules to control a lighting network is depicted. In a brief overview of method 400, at step 405, a user identifies, via a configuration tool, one or more inputs to an interface module for configuring a rule. At step 410, the user specifies via the configuration tool one or more lighting effects to occur via one or more lighting control modules responsive to the user identified input. At step 415, the configuration tool generates one or more user specified rules in a form to be executed via the interface module. At step 420, the user interface receives or is provided the generated rules in executable form. At step 425, the interface module receives data via one or more ports. At step 430, the interface module detects receipt of the user identified input. At step 435, the interface module executes the rule in response to the detection. At step 440, the interface module triggers rule specified lighting effects.

In further details, at step 405, a user identifies, via a configuration tool, any type and format of one or more inputs to an interface module for configuring a rule. A user identified input may comprise any data type or a portion of a data stream. The input may include a specific value of a specific data type out of plurality of data types available on the interface module. The user may identify any input selected from a plurality of inputs available via any part or interface of the interface module. In some embodiments, the user identifies a threshold value to be compared against a stream of values from a source, such as a detector or a sensor. The user identified threshold value for the value from the sensor may be the input identified by the user to be used for configuring a rule. In some embodiments, the user identifies a color of light as an input for configuring a rule. In a number of embodiments, the user identifies a value corresponding to a brightness level as an input configuring a rule. In a number of embodiments, the user identifies a source or a stream of data from a website or a webpage as an input for configuring a rule. In some embodiments, the user identifies an analog or a digital value as an input for configuring a rule. In some embodiments, the user identifies a data point as an input to be used for configuring a rule. Sometimes, the user may identify a color, a luminance value or a brightness value to be used as an input for configuring a rule.

In a variety of embodiments, the user identifies a stream of data from a website as an input for configuring a rule. For example, the stream of data identified may correspond to a weather information about a particular location. In some embodiments, the user identifies a stream of data corresponding to a stock information from the stock market as an input for configuring a rule. In identifying the input, the user may specify the port or interface of the interface module and/or one or more data values received via the port or the interface. In some embodiments, in identifying the input the user specifies a data stream from a plurality of streams of data inputs and further specify one or more specific data points within the selected stream. The user may identify any data or value to be received via any type and form of network interface to the interface module. In some embodiments, the user identifies any portion of a network packet as an input. The user may identify or specify any part or a header of a network packet of any type and form of protocol. The user may identify from plurality of data streams traversing the interface module, a data stream based on a unique identifier of the source of the data stream and further identify specific network packets or data to be used as inputs. In some embodiments, the user identifies a voltage value, such as a 0V or a 10V value as an user input for configuring a rule. In some embodiments, the user identifies a value corresponding to a threshold value for a motion sensor as an input for configuring the rule. In many embodiments, the user identifies a value corresponding to a threshold value for a temperature sensor as an input for configuring the rule. In some embodiments, the user identifies a value corresponding to a threshold value for a timer as an input for configuring the rule.

At step 410, the user via the configuration tool specifies any type and form of lighting effects for the rule to trigger responsive to the user identified inputs. The lighting effects may include any one or more of the following, in any combination: turning lights on or off, introducing delay to turning light on or off or to any other lighting effect, timing loops for managing a plurality of light sources, color changes, changes to temperature of one or more lights, dimming, fading of lights, change of intensity, brightness, or wavelength, pulsing of light, flash of light and more. In some embodiments, the user specifies via the configuration tool the intensity or wavelength of the light to be emitted in response to one or more user identified inputs. In many embodiments, the user specifies the continuous light output or a pulsing of light output to be emitted in response to one or more user identified inputs. In various embodiments, the user specifies via the configuration tool a number of colors of light to be emitted from a number of light sources in response to one or more user identified inputs. In some embodiments, the user specifies a sequence of lights to be emitted, such as for example a sequence to emit a green light, followed by a red light, followed by a yellow, etc. In a number of embodiments, the user specifies via the configuration tool a loop sequence assigning the order in which specific light sources will emit when the user identified input is encountered. In some embodiments, the user specifies via the configuration tool the pulse duration for the pulses of light the light sources will emit in response to one or more user identified inputs. In many embodiments, the user specifies the timing scheme for the synchronized output of a plurality of light sources. The timing scheme may specify duration of time for which each light source will emit in response to one or more user identified inputs. Sometimes, the user may specify a first lighting effect to take place in response to a first user identified input and a second lighting effect to take place in response to a second user identified input. In some embodiments, the user specifies a third and fourth lighting effects for the rule to trigger in response to a third user identified input. In many embodiments, the user specifies a specific lighting effect for the rule to trigger in response to two user identified inputs. In some embodiments, the user specifies a lighting effect requiring one or more controllers controlling plurality of light sources to turn the plurality of light sources on or off in a specific order. In many embodiments, the rule may instruct one or more LCMs to implement one or more lighting effects via any number of light sources.

At step 415, the configuration tool generates one or more user specified rules in a form of executable instructions to execute via the interface module or any component of the lighting network. In some embodiments, the configuration tool generates any number of rules in any type and form of executable instructions, such as an executable file, application, program, library, process, script or service. In many embodiments, the configuration tool generates one or more rules in a form of a source code. In some embodiments, the configuration tool generates one or more rules in a form of a compiled code. In various embodiments, the configuration tool generates one or more rules in a form of an executable file. The configuration tool may generate any number of rules in a form of a script. In some embodiments, the configuration tool generates one or more rules in a form of a library of rules. In many embodiments, the configuration tool generates one or more rules in a form of functions ready to be implemented. In some embodiments, the configuration tool generates one or more rules in a form of an interpreted code, such as java code or a java script. In a plurality of embodiments, the configuration tool generates one or more user specified rules in a form of functions, logic functions or procedures to execute the rules.

In some embodiments, at step 415, the configuration tool generates executable instructions for the user specified rule to represent a specific user identified input. In some embodiments, the configuration tool generates a rule in a form of user executable instructions to represent a specific user specified lighting effect. The configuration tool may generate one or more of executable instructions of the user specified rule to be executed by one or more controllers of the LEDs 108, such as an LCM 106. In some embodiments, the configuration tool generates executable files comprising functions, signals and instructions from components such as sensors or detectors, algorithms or software, circuitry or controllers used to operate or control any one of UIM 102, LCM 106, LED drivers 107 and LEDs 108. Each of the executable files may be executed by one or more control modules, such as LCM 106, one or more LED drivers 107 or one or more LED 108. In some embodiments, the configuration tool generates a rule comprising an executable program or a code comprising steps, commands, instructions and data enabling a control module, such as a LCM 106, to implement, trigger or execute each user specified lighting effect. In a plurality of embodiments, the configuration tool generates a rule comprising an executable program or a code comprising steps, commands, instructions and data enabling a control module, such as a LCM 106, to implement, trigger or execute each user identified input. The generated rules may comprise information specifying which LED 108 sources will be utilized, which LCM 106 control modules will be utilized and when. The generated rules may be stored by the interface module for further use in case the user identifies same user inputs or same user specified lighting effects. The generated rules may be created or generated each time the user identifies new inputs or specifies new lighting effects.

At step 420, the interface module receives or is provided the executable instructions comprising the user specified rule via any type and form of interface. The interface module may receive executable instructions comprising the user specified rule via any configuration file, boot file, uploaded or downloaded file, file received via a network or from a file stored on the interface module. In some embodiments, the interface module receives or is provided the executable instructions comprising one or more user specified rules from the configuration tool. In many embodiments, the interface module receives or is provided the executable instructions comprising one or more user specified rules from a user's computer via a network 104. In some embodiments, the interface module receives or is provided the executable instructions from configuration files stored on a network. In some embodiments, the interface module receives or is provided executable files by loading boot files. In some embodiments, the interface module is provided executable files via a file transfer protocol (FTP) transmission. In a number of embodiments, the interface module receives or is provided the executable instructions over the network 104. Sometimes, the configuration tool provides the executable instructions to the interface module over the network 104. Sometimes, the user takes the executable instructions from the configuration software and provides them to the interface module.

At step 425, in operation of the interface module, the interface module receives data via one or more ports or interfaces. The interface module may receive a plurality of streams of data via any number of communication means. The data received by the interface module may comprise any stream of data, stream of values or readings, instructions, commands, signals, calibration values or any data points traversing the interface module. In some embodiments, the interface module receives data from a plurality of sources, such as sensors, circuits, controllers, websites comprising data from stock markets or weather, and more. The interface module may monitor the data as the data traverses the module. The interface module may differentiate data from one data source from data from another data source. The data traversing the interface module may include any number of instructions which may be used to control, command or operate any one of the interface module, control module, such as a LCM 106, driver, such as a LED driver 107 or a lighting source, such as a LED 108. The interface module may receive data, instructions or signals via any communication means. In some embodiments, the interface module includes one or more communication ports receiving commands, instructions or data via a network port, such as a modem connected to network 104. In a number of embodiments, the interface module includes one or more wireless communication links which receive commands, instructions or data via a wireless signal or a wireless port. In some embodiments, the interface module receives data via a port receiving a radio signal or a radio wave. In a number of embodiments, the interface module receives data via a port receiving a satellite signal. In a plurality of embodiments, the interface module receives data via a plurality of ports of the same or different kinds. In a number of embodiments, the interface module receives data via any number of ports from any one, or any combination of a configuration tool, LCM 106, LED 107 or LED 108.

At step 430, the interface module detects from any of the received data from any of its ports the user identified input of the rule. The interface module may detect the user identified input from the received data using any detection or matching technique. In some embodiments, the interface module detects the user identified input by reading, parsing and interpreting data received such as portions of a network packet or one or more data values. In some embodiments, the interface module identifies the user identified input from the received data by parsing the received data and matching the parsed data to the user identified input. In some embodiments, the interface module detects from a plurality of data traversing the interface module the user identified input. In some embodiments, the user identified input is detected from a stream of data from a plurality of streams of data traversing the interface module. In some embodiments, the interface module detects from a network port a first user identified input, and from another communication port a second user identified input. In some embodiments, the interface module detects a plurality of user identified inputs from a variety of data streams or data sources traversing the interface module via any number of communication ports. In a plurality of embodiments, the interface module detects from the received data a plurality of user identified inputs of the rule. In some embodiments, the interface module detects a plurality of user identified inputs from a plurality of portions of data received from a plurality of interface module communication ports.

At step 435, the interface module, responsive to the detection of the user identified input of the rule, executes the rule. The interface module and/or any other component of the lighting network may execute any executable instruction of the user specified rule or any portion thereof. In some embodiments, the interface module executes the rule. In many embodiments, the LCM executes the rule. In many embodiments, the interface module executes a first part of the rule and another component of the lighting network executes a second portion of the rule. In some embodiments, the interface module instructs a component, such as a LCM, to execute the rule. In some embodiments, the interface module is already executing the executable instruction of the user specified rule to detect the user specified input. Upon detection, additional instructions, logic, operating or functions of the executable instruction are executed. In some embodiments, the interface module executes the rule generated in response to the detection of the user specified input. In many embodiments, the interface module executes the rule generated in response to a portion of data received by the interface module. In some embodiments, the interface module creates or generates the rule in response to a portion of data received by the interface module. In a number of embodiments, the interface module modifies the rule generated in response to a portion of data received by the interface module. The interface module may modify the rule generated in response to an input, a command, a signal or an instruction from the data received by the interface module. The interface module may execute the modified rule.

At step 440, the interface module, responsive to execution of the rule, causes the triggering of the one or more lighting effects specified by the rule via any type and form of interface to one or more control modules, such as a LCM 106. In some embodiments, the interface module causes triggering of the lighting effects via any component of the lighting network. In some embodiments, the interface module triggers one or more lighting effects specified by the rule via the control module such as an LCM 106, a driver such as a LED driver 107 or a lighting source such as a LED 108. In many embodiments, the interface module triggers one or more lighting effects specified by the rule via any number or any type of lighting network components, such as any number of LCMs, LEDs and more. In some embodiments, the interface module transmits one or more of the executable instructions to the LCM 106 to specify, control or instruct the LCM 106 to execute the lighting effects specified by the user. The interface module may, in response to the execution of the rule, transmit one or more executable instructions to a component or a device on the lighting network 175 to trigger the execution of the one or more user specified lighting effects. In some embodiments, the interface module, responsive to the execution of the rule, causes triggering of the one or more lighting effects specified by the rule according to the identified inputs by the user. In some embodiments, the interface module, responsive to the execution of the rule, causes triggering of the one or more lighting effects specified by the modified rule. In some embodiments, the rule triggers one or more other rules to be executed by any number of lighting network components.

We claim:

1. A method for executing a user specified rule to control lighting effects in a lighting network comprising an interface module in communication with one or more lighting control modules, the method comprising:

(a) receiving, by an interface module, a rule for controlling a lighting network, the interface module in communication with one or more lighting control modules of the lighting network, the interface module comprising one or more ports to receive data as input by changing a state of a port of the one or more ports from transmit mode to listen mode, the rule comprising a user identified input specifying a value to be detected in data of a data stream to be received by at least one port of the one or more ports of the interface module and a user specified lighting effect to occur via the one or more lighting control modules responsive to the interface module receiving the user identified input, the value to be used as input to the rule upon detection;

(b) detecting, by the interface module from the stream of data received via the at least one port, receipt of the value specified by the user identified input; and (c) executing, by the interface module responsive to the detection of receipt of the value specified by the user identified input, the rule to trigger the user specified lighting effect via the one or more lighting control modules.

2. The method of claim 1, wherein step (a) further comprises receiving, by the interface module, a set of executable instructions comprising the rule.

3. The method of claim 2, wherein step (a) further comprises receiving, by the interface module, the rule comprising a user specified predetermined threshold of the user identified input for which to trigger the user specified lighting effect.

4. The method of claim 1, wherein step (b) further comprises receiving, by the interface module, data as input via one or more analog or digital ports of the interface module.

5. The method of claim 1, wherein step (b) further comprises receiving, by the interface module, data as input via an input port comprising a network port of the interface module.

6. The method of claim 1, wherein step (b) further comprises detecting, by the interface module, the user identified input from a stream of data received via an input port of the one or more ports.

7. The method of claim 1, wherein step (c) further comprises communicating one or more instructions to the one or more lighting control modules to produce the user specified lighting effect.

8. The method of claim 1, wherein step (c) further comprises communicating one or more instructions to the one or more lighting control modules to produce the user specified lighting effect for a user specified time period.

9. The method of claim 1, wherein step (c) further comprises communicating instructions to program the one or more lighting control modules.

10. A method for configuring a user specified rule to control lighting effects in a lighting network comprising an interface module in communication with one or more lighting control modules, the method comprising:

(a) receiving, by a configuration tool, a user's identification of value to be detected in data of a data stream to be received via one or more ports of an interface module for controlling one or more lighting control modules of a lighting network, the value to be used as an input to the rule upon detection, a state of a port of the one or more ports changing from transmit mode to listen mode;

(b) receiving, by the configuration tool, a user's specification of a lighting effect to occur via the one or more lighting control modules and responsive to a receipt of the value specified by the user identified input in data of the data stream to be received via at least one port of the one or more ports; and (c) providing, by the configuration tool, for execution on the interface module a rule comprising the user specified lighting effect to occur via the one or more lighting control modules responsive to the receipt of the value specified by the user identified input in data of the data stream to be received from at least one port of the one or more ports.

11. The method of claim 10, wherein step (a) further comprises receiving a user's identification of a value of data that may be received by an analog or digital input port of the interface module.

12. The method of claim 10, wherein step (a) further comprises receiving a user's identification of a value of data that may be received via a network interface of the one or more ports of the interface module.

13. The method of claim 10, wherein step (a) further comprises receiving a user's identification of the input based on a type of interface configured on the one or more ports of the interface module.

14. The method of claim 10, wherein step (b) further comprises receiving a user's specification of the lighting effects as a sequence of one or more instructions to communicate to the one or more lighting control modules.

15. The method of claim 10, wherein step (b) further comprises receiving a user's specification of the lighting effects as a sequence of one or more instructions to communicate to the one or more lighting control modules.

16. The method of claim 10, wherein step (b) further comprises receiving a user's specification of the lighting effect as an identification of a program to execute on the one or more lighting control modules.

17. The method of claim 10, wherein step (b) further comprises receiving a user's specification of the lighting effect as an identification of a program to execute on the interface module.

18. The method of claim 10, wherein step (b) further comprises the user specifying a lighting scheme for the lighting effect.

19. The method of claim 10, wherein step (c) further comprising generating, by the configuration tool, a set of executable instructions representing the rule.

20. The method of claim 19, further comprising communicating the set of executable instructions to the interface module.

21. The method of claim 1, wherein the at least one port is a unidirectional port.

22. The method of claim 1, wherein the port of the one or more ports and the at least one port of the one or more ports are the same port.

23. The method of claim 10, wherein the at least one port is a unidirectional port.

24. The method of claim 10, wherein the port of the one or more ports and the at least one port of the one or more ports are the same port.

* * * * *